US005828935A

United States Patent [19]

Tatsumi et al.

[11] Patent Number: 5,828,935

[45] Date of Patent: Oct. 27, 1998

[54] IMAGE FORMING APPARATUS, TONER SUPPLY UNIT, AND TONER BOTTLE ATTACHED THERETO

[75] Inventors: Kenzo Tatsumi; Noboru Kusunose, both of Yokohama; Shigeru Yoshiki, Tokyo, all of Japan

[73] Assignee: Ricoh Company, Ltd., Tokyo, Japan

[21] Appl. No.: 729,525

[22] Filed: Oct. 11, 1996

[30] Foreign Application Priority Data

| | | | |
|---|---|---|---|
| Oct. 11, 1995 | [JP] | Japan | 7-263085 |
| Oct. 25, 1995 | [JP] | Japan | 7-277756 |
| Aug. 25, 1996 | [JP] | Japan | 8-242587 |

[51] Int. Cl.[6] ..... G03G 15/08

[52] U.S. Cl. ..... 399/260; 399/258

[58] Field of Search ..... 399/262, 258, 399/119, 260; 222/DIG. 1

[56] References Cited

U.S. PATENT DOCUMENTS

| | | | |
|---|---|---|---|
| 4,641,945 | 2/1987 | Ikesue et al. | 399/262 |
| 5,235,389 | 8/1993 | Kikuchi et al. | 222/DIG. 1 X |
| 5,257,077 | 10/1993 | Peters, Jr. et al. | 222/DIG. 1 X |
| 5,416,568 | 5/1995 | Yoshiki et al. . | |
| 5,441,177 | 8/1995 | Yanagisawa | 222/DIG. 1 X |
| 5,455,662 | 10/1995 | Ichikawa et al. . | |
| 5,495,323 | 2/1996 | Meetze, Jr. | 222/DIG. 1 X |
| 5,500,719 | 3/1996 | Ichikawa et al. . | |
| 5,528,349 | 6/1996 | Satake | 399/262 |
| 5,557,382 | 9/1996 | Tatsumi et al. | 399/262 |
| 5,627,631 | 5/1997 | Ishikawa et al. | 222/DIG. 1 X |

OTHER PUBLICATIONS

Patent Abstracts of Japan, JP–A–6–24460, Aug. 5, 1994.
Patent Abstracts of Japan, JP–A–63–75769, Apr. 6, 1988.

*Primary Examiner*—S. Lee
*Attorney, Agent, or Firm*—Oblon, Spivak, McClelland, Maier & Neustadt, P.C.

[57] ABSTRACT

A toner bottle (38) has projections (38*c*, 38*c*′) on its bottom surface. The projections (38*c*, 38*c*′) extend in the axial direction but are spaced away from the central-axis line of the toner bottle (38). The projections (38*c*, 38*c*′) are engaged with convex portions (62*b*, 62*b*′) formed in a joint (62) of a drive portion (60). When the drive portion (60) starts rotating, the torque is transferred to the toner bottle (38) via the projections (38*c*, 38*c*′) and the convex portions (62*b*, 62*b*′). Since the torque is transferred from the bottom side of the toner bottle (38), the toner bottle (38) can be attached to or detached from a body of an image forming apparatus in a direction of the central-axis line. Toner discharged from the toner bottle (38) is introduced into a process cartridge through an opening portion (48) of a toner hopper portion (40) and a toner introducing cover (52). A shutter member (88) is disposed in the toner introducing cover (52). The shutter member (88) consists of a flexible elastic member (90) and a holding member (92) for holding the elastic member (90). The shutter member (88) intersects with the opening plane of a toner supplying port. Guiding portions for bending and guiding the elastic member (90) along the toner supplying port are also disposed in the toner introducing cover (52).

24 Claims, 29 Drawing Sheets

IMAGE FORMING APPARATUS, TONER SUPPLY UNIT, AND TONER BOTTLE ATTACHED THERETO

BACKGROUND OF THE INVENTION

1. Field of the Invention

The present invention relates to in image forming apparatus, such as a copying machine, a printer, a facsimile machine and the like, a toner supply unit which supplies toner to a developing section of the image forming apparatus, and a toner bottle attached thereto.

2. Description of the Prior Art

A conventional image forming apparatus comprises a process cartridge including an image bearing medium, a developing unit, and the like, and a toner supply unit which supplies toner to a developing unit. Both the process cartridge and the toner supply unit are attachable to and detachable from the image forming apparatus. A toner supply port is,formed on the side of the toner supply unit, whereas a toner receiving port is formed on the side of the process cartridge. The toner supply port faces the toner receiving port when the toner supply unit and the process cartridge are attached to the image forming apparatus.

In the image forming apparatus, toner can be supplied through the toner supply port and the toner receiving port facing each other. However, a construction is required in which the toner supply port is connected to the toner receiving port only when the toner supply unit is attached to the image forming apparatus from the viewpoint of avoiding damage to the apparatus or a poor work environment which is caused by scattered toner.

Therefore, prior art references ① to ① shown in the following have been proposed.

① An image forming apparatus in which a shutter member is disposed in a toner supply port and is driven to open and close the toner supply port by the fixing and releasing operation of a means for fixing and releasing a process cartridge which is operated after a process cartridge is attached to a body of the image forming apparatus body (Japanese Patent Application Early Laid-Open Publication No. Hei 2-201380).

② An image forming apparatus in which a shutter member is disposed in a toner supply port and is driven to open and close the toner supply port in accordance with the attaching and detaching operation of a toner cartridge with respect to a body of the image forming apparatus (Japanese Patent Application Early Laid-Open Publication No. Sho 56-120555). ③ An image forming apparatus in which a shutter member disposed in a toner supply port is driven by a clutch mechanism a driving source of which is a solenoid or the like (Japanese Patent Application Early Laid-Open Publication No. Hei 2-226268).

Generally, a toner bottle containing toner is mounted in a toner supply unit. It is well known that the toner bottle is attachable to and detachable from the toner supply unit. As regards the toner bottle which is freely attached to and detached from the toner supply unit, the following prior art references ④ to ⑤ have been proposed.

④ A toner supply unit in which a toner bottle is driven and rotated to an attaching and detaching position of the toner bottle a state in which the toner bottle has been connected to a developing unit, in other words, a state in which the toner bottle is held horizontally when the toner bottle is attached or detached (Japanese Patent Application Early Laid-Open Publication No. Hei 5-9194). Since this rotating operation needs a space, it is carried out in the front of the image forming apparatus.

⑤ A toner supply unit in which a toner bottle is supported rotatably on fulcrum points formed in the outer both ends thereof and torque is transferred from at least one of the fulcrum points (Japanese Patent Application Early Laid-Open Publication No. Hei 3-2882).

Generally, in an image forming apparatus, an electrostatic latent image formed on a thin layer of photosensitive medium in visualized by adhesion of toner supplied from a developing unit, and a visible image is transferred onto a recording sheet. After that, it becomes a record object by a fixation process and is discharged out of the apparatus. Since toner is consumed by development, consumed quantity of toner is supplied with a toner supply unit. A so-called toner bottle containing toner is disposed in the toner supply unit attachably and detachably. The toner bottle is exchanged with a new toner bottle filled with toner, which is kept at hand, when the toner bottle becomes empty.

The toner bottle comprises a cylindrical body portion, a bottom portion by which one end thereof is closed, and a port portion for discharging toner which is formed into such a shape that the other end thereof is narrowed down. A spiral groove for transferring toner is formed extending from the body portion on the side of the bottom portion to the port portion in the inside wall ranging from the body portion to the port portion. Thereby, toner in the body portion passes through the spiral groove by rotation and is transferred to the outside, namely, the developing unit, via the port portion.

As mentioned above, the toner bottle is rotated by action of outside power, which is obtained from the side of the port portion in a conventional toner bottle. Prior art references ⑧ to ⑦ shown in the following have been proposed as this type of toner bottle.

⑥ A toner bottle in which a projection is formed at a portion having a difference in level or a so-called shoulder portion which is narrowed down in a port portion, and the projection is engaged with a claw portion for driving to rotate which is disposed in the toner supply unit and is connected to the source of a drive, and thereby the toner bottle can be rotated.

⑦ A toner bottle in which a secondary gear which is geared with a circumferential surface of the toner bottle is disposed near a port portion of the body portion, and a rotatable drive gear which is connected to a driving source is engaged with the secondary gear to rotate the toner bottle.

In the aforementioned prior art references, nonetheless, the image forming apparatus shown in reference ① does not have any shutter member for opening and closing a toner receiving port formed in a developing unit of an imaging unit, and thus, not only the corruption or destruction inside the apparatus may be caused by scattering toner, but also toner may scatter when the imaging unit is removed from the body of the image forming apparatus. Moreover, since it is composition of driving the shutter member by operating means for fixing the imaging unit after the imaging unit is mounted in the image forming apparatus, there can be trouble of complicating operation procedure.

While the image forming apparatus shown in reference ② is constructed to drive a shutter member by operation of attaching or removing a developing unit so that the improvement in operativity can be realized, the corruption or destruction inside the apparatus caused by scattering toner cannot be prevented from occurring because there is not any shutter member for opening and closing a toner receiving port of a developing unit, similarly to the aforementioned prior art reference ①.

In the image forming apparatus shown in reference ③, a clutch mechanism is used so that the cost of the entire apparatus falls into becoming higher.

Incidentally, it can be expected to be solvable in the problems described above if the shutter members are disposed in both the toner supply port and the toner receiving port and then are opened and closed by the operations of attaching to and removing from the image forming apparatus body which is a driving source.

In this case, it is general that each of the shutter members is moved parallel along the toner supply port and the toner receiving port, respectively.

In recent years when an image forming apparatus is miniaturized rapidly, however, there are many cases in which it is difficult in consideration of the configuration of an apparatus, arrangement and a layout space that each of the shutter members is moved parallel along the toner supply port and the toner receiving port, respectively.

In the image forming apparatus shown in reference ④, a vessel for containing toner is rotated in the front of the body of the image forming apparatus with respect to the attachment and removal of the toner containing vessel because the function of exchanging the toner containing vessel is required to heighten. As a result, a considerable space is required for the rotational operation so that the size of a whole apparatus needs to be enlarged regardless of the demand of miniaturizing the apparatus in recent years.

In the image forming apparatus shown in reference ⑤, a vessel for containing toner of which a toner discharging port is formed in the middle part of one end is used since this construction has an advantage of preventing toner from scattering. In the construction, however, a system of transferring a drive of rotational-driving means becomes complicated because the toner discharging port is formed in the Riddle part. Besides, a shaft member having a function of holding the central portion of the other end of the toner containing vessel needs to be used, which makes the cost of the apparatus higher.

In the toner bottle shown in reference ⑥, a toner transferring mechanism is disposed complicatedly in a part adjacent to the port portion and the claw portion for driving and members relevant thereto is disposed in this part. This construction may cause various problems such as complicating a structure, being incapable of miniaturizing an apparatus, and making it difficult to supply toner stably because the bottom side of the toner bottle is swayed easily.

In the toner bottle shown in reference ⑦, the toner bottle is rotated by the engagement with the drive gear adjacent to the JUDO gear, and then the force caused by the torque, by which the toner bottle slips toward the direction right-angled for the axis, is given to the toner bottle. Thus, normal rotation is not performed because of flotation or horizontal slips of the toner bottle in such a simple construction of the apparatus that the toner bottle is accommodated in a concave groove. In order to prevent those slips, the toner bottle is required to be supported by enclosing the entire circumference thereof, yet, if that is carried out, attachment-and-removal of the toner bottle cannot be operated smoothly.

SUMMARY OF THE INVENTION

It is therefore a first object of the present invention to provide an image forming apparatus which is capable of solving problems, such as toner scattering or high costs, and additionally capable of allowing the apparatus to be made small-sized in accordance with fixed conditions of, for example, a layout space.

It is a second object of the present invention to provide a toner supply unit which is capable of easily exchanging a toner receiving container in a relatively small space and which has low production costs and a compact-sized and simple construction.

It is a third object of the present invention to provide a toner bottle which has a simple construction and is easily attached and detached.

To achieve the objects, an image forming apparatus according to an aspect of the present invention comprises a toner supply unit which is directly or indirectly attached to and removed from a body of the image forming apparatus having a toner receiving port, a toner supply port which faces the toner receiving port when the toner supply unit is attached to the image forming apparatus body, and a shutter member for opening and closing the toner supply port. The shutter member has a bendable elastic member and a holding member for holding the elastic member and is disposed intersecting with an opening surface of the toner supply port. A guiding portion for bending and guiding the elastic member along the toner supply port is disposed in the toner supply unit.

In the image forming apparatus, an opening/closing function can be obtained certainly even in a case in which the shutter member which moves parallel along the toner supply port cannot be disposed for lack of an installed space. Thereby, the image forming apparatus can be constructed more freely, and additionally the apparatus can be made smaller-sized.

Preferably, in the image forming apparatus, there are formed a projecting portion in the shutter member, and a guiding rib which drives to open or close the shutter member by engagement with the projecting portion on the side of the image forming apparatus body.

The shutter member can be opened or closed by attaching and detaching the toner supply unit.

Preferably, in the image forming apparatus, there is formed an elastic sealing member with which an end of the elastic member is brought into contact when the toner supply port is closed by the shutter member in the toner supply unit.

In the image forming apparatus, a sealing function of preventing toner from scattering is improved without undergoing damage, such as breaking or bending, to the elastic member.

Preferably, in the image forming apparatus, there is formed a guide for regulating deformation by which the elastic member is regulated to deform while moving, facing the surface opposite to a surface on which the elastic member contacts the guiding portion in the toner supply unit.

In the image forming apparatus, bend and deformation of the elastic member required for opening and closing the toner supply port is certainly obtained without the elastic member being deformed unexpectedly even in a case in which the elasticity of the elastic member is insufficient.

Preferably, in the image forming apparatus, the toner receiving port and the guiding rib are disposed in a process cartridge in which at least an image bearing body and a developing unit are installed integrally to be able to be freely attached to and removed from the image forming apparatus body, and a second shutter member for opening and closing the toner receiving port is disposed in the process cartridge, and a second projecting portion is formed in the second shutter member. On the other hand, a second guiding rib for driving to open and close the second shutter member by being engaged with the second projecting portion is disposed in the toner supply unit. The guiding rib and the second guiding rib each have a trapezoidal shape and intersect mutually in the direction of a convex.

In the image forming apparatus, opening-and-closing operation of both the shutter members can be performed regardless of the attachment-and-removal order of the toner supply unit and the process cartridge. Therefore, operational efficiency is improved. Moreover, a given space can be used effectively and the miniaturization of the apparatus can be achieved by the intersectional system of the guiding rib.

A toner supply unit according to an aspect of the present invention comprises a toner bottle having a toner discharging port in the middle part of an end of a cylindrical container body, a bottle holding means for holding the toner bottle substantially horizontally in a state in which toner can be introduced into a toner introducing portion of a developing unit from the toner discharging port, and a rotational driving means for rotating the toner bottle held on the bottle holding means around the central axis of the toner bottle in the longitudinal direction of the toner bottle, in which the toner bottle can be attached to and removed from the unit body in the direction of the central axis in a state in which the toner bottle is held by the bottle holding means.

In the toner supply unit, a toner receiving container can be attached to and removed from the unit body in a state of being held on the bottle holding means. Thereby, the space in the unit can be used effectively without spoiling the exchangeability of the toner receiving container, as well as, a miniaturization of the unit can be realized.

Preferably, in the toner supply unit, the toner bottle has a concave portion formed in the middle of the other end opposite to the end in which the toner discharging port is formed, and the rotational driving means has an engagement portion for transferring a driving force by engagement with the concave portion.

Preferably, in the toner supply unit, the engagement portion of the rotational driving means with the concave portion has both of the functions of positioning the toner bottle and transferring the rotational driving force and, in addition, the torque of the rotational drive can be made smaller.

Preferably, in the toner supply unit, the toner bottle has a convex portion formed in the middle of the other end opposite to an end in which the toner discharging port is formed, and the rotational driving means has an engagement portion for transferring a driving force by engagement with the convex portion.

A toner bottle according to an aspect of the present invention comprises a cylindrical body portion as a container for receiving toner, a bottom portion with which an end of the body portion is closed, and a port portion for discharging toner which is narrowly formed. The cylindrical body has a spiral groove for transferring toner which is formed in the inner wall of the body and extends from the body portion on the side of the bottom portion to the port portion. The toner is allowed to pass through the spiral groove by the rotation of the body and be discharged from the port portion. In the toner bottle, a projection in the axial direction for transferring a rotational force thereto is disposed at a position away from the central axial line of the cylindrical body portion outside the bottom portion.

In the toner bottle, since the driving force is obtained from the axial direction, a lateral slip perpendicular to the axis can be prevented and thereby toner is supplied stably. Furthermore, the construction of a driving system can be made simple because the projection serving as the driving system and extending in the axial direction on the bottom side of the toner bottle on which there is a space enough to arrange other members.

Preferably, in the toner bottle, a center for determining a central position is disposed on the central axis outside the bottom portion. The center extends in the longitudinal direction more than the projection.

In the toner bottle, the connection of the driving system with the projection can be automatically carried out on the basis of the center, thus being carried out smoothly and steadily.

Preferably, in the toner bottle, the bottom portion has a convex circumferential portion on which a ring with a predetermined width in the longitudinal direction is fitted rotatably by engagement means. The engagement means prevent the ring from coming off from a body of the toner bottle in the longitudinal direction when the ring rotates.

In the toner bottle, an inseparable connection between the ring and the toner bottle is ensured.

Preferably, in the toner bottle, the predetermined width of the ring is designed so that an end surface of the outer side of the ring in the longitudinal direction is located out of the center.

In the toner bottle, since the surface of the ring is situated outside the projection which juts out of the bottom portion of the toner bottle, the toner bottle can be stood. Thus, the toner bottle is prevented from rolling or falling accidentally.

Preferably, in the toner bottle, a projection extending radially is formed in the circumferential surface of the ring. The projection is engaged with a concave portion of an immovable member.

In the toner bottle, since the ring rotatably holding the toner bottle is fixed around the immovable member, the toner bottle can be rotated without generating vibration or slippage. Besides, the ring is easily attached to and detached from the immovable member.

Preferably, in the toner bottle, a projection for preventing the toner bottle from being interchanged with other types of toner bottles is formed in the ring.

In the toner bottle, an accident can be avoided which is caused by attaching a toner bottle other thin a proper predetermined toner bottle to the image forming apparatus by mistake.

Preferably, in the toner bottle, the engagement means comprises a stopper formed in the inner part of the ring, an elastic claw, and the convex circumferential portion held between the stopper and the elastic claw.

In the toner bottle, an inseparable connection between the ring and the toner bottle is ensured.

Preferably, in the toner bottle, the diameter of the convex circumferential portion is smaller than that of the body portion and is set so that the elastic claw is placed in an end plane space defined by a radial difference between the convex circumferential portion and the body portion in a state in which the ring is engaged with the toner bottle.

In the toner bottle, an inseparable connection between the ring and the toner bottle is ensured.

Preferably, in the toner bottle, a cylindrical intermediate portion is formed in a part closer to the bottom portion than the port portion inside the body portion. The cylindrical intermediate portion serves to hold the toner bottle and is engaged with a cylindrical bottle-holding member for leading toner discharged from the port portion by simultaneous rotation with the toner bottle to a predetermined position. A small projection is formed in the peripheral part of the intermediate portion in order to position the toner bottle rotatably in a state in which the center of the toner bottle comes out in the inner circumferential part of the toner receiving stand.

In the toner bottle, since the toner bottle is rotated without rotational deflection, toner can be supplied stably.

Preferably, in the toner bottle, a cylindrical intermediate portion is formed between the port portion and the body portion. The cylindrical intermediate portion is engaged with a cylindrical bottle-holding member for holding the toner bottle and leading toner discharged from the front part of the bottle to a predetermined position by simultaneous rotation with the toner bottle. Further, driving claws are formed on the end surface of the intermediate portion on the side of the port in order to transfer torque to the bottle holding-member.

In the toner bottle, a member for conveying toner can be driven by the use of the rotation of the toner bottle.

BRIEF DESCRIPTION OF THE DRAWINGS

FIG. 12(*b*) is a sectional view of the second shutter member, showing a state in which the second shutter member has been opened.

FIG. 13(*b*) is a sectional view of the elastic member, showing a state in which it has been opened.

FIG. 14(*b*) is a sectional view of the second shutter member, showing a transitional state from the closed state to the opened state.

FIG. 14(*c*) is a sectional view of the second shutter member, showing a state in which it has been opened.

FIG. 26 (*b*) is a front view of the ring.

FIG. 30 is a partially sectional view showing a state in which the toner bottle with the ring has been attached to the toner receiving stand and.

DETAILED DESCRIPTION OF THE PREFERRED EMBODIMENTS

Preferred embodiments of an image forming apparatus, a toner supply unit, and a toner bottle of the present invention will hereinafter be described in details in accordance with the accompanying drawings.

Figure 1:
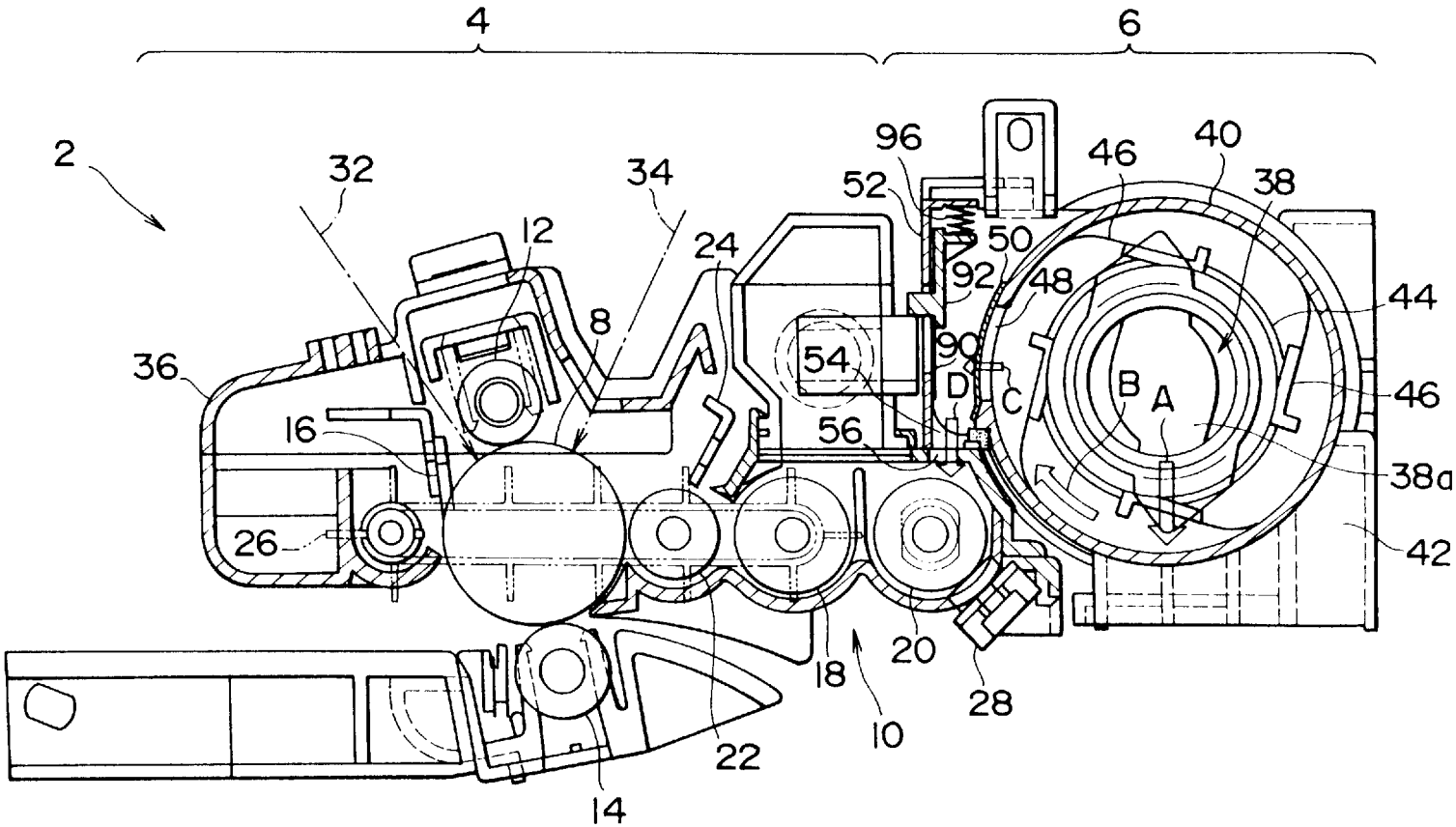
FIG. 1 is sectional view of an image forming apparatus.

As shown in FIG. 1, an image forming apparatus 2 comprises a process cartridge 4 which is disposed in a state of being attachable to and removable from an image forming apparatus body (not shown), and a toner supply unit 6 which is disposed in a state of being attachable to and removable from the process cartridge 4. A photosensitive object 8 as an image bearing body and a developing unit 10 are placed integrally in the process cartridge 4.

A charged roller 12, a transfer roller 14, a cleaning blade 16 and the like are disposed around the photosensitive object 8. Agitating screws 18, 20, a development sleeve 22, a doctor blade 24 etc. are disposed in the developing unit 10. In FIG. 1, reference character 26 designates a toner recycling belt and reference character 28 designates a toner density sensor.

Imaging operation is performed as follows.

The surface electric potential of the photosensitive object 8 is reduced by an electric-charge-elimination light 32 and is uniformalized in the range of 0 to −150 V, and then it is charged until approximately −1100 V by the charged roller 12. Next, the surface electric potential of an area (image formed area) into which light has been projected in the photosensitive object 8 is exposed to light by exposure light 34 to cone in the range of 0 to −290 V. Bias voltage of approximately −800 V is impressed on the development sleeve 22, and thereby the toner placed on the development sleeve 22 adheres to the image formed area.

The photosensitive object 8 in which the toner image has been formed rotates and then a transfer sheet is sent thereinto from a sheet supply portion, and then the transfer sheet is sent at a timing in which the forefront thereof corresponds to the forefront of the image at a position in which the transfer roller 14 comes in contact with the photosensitive object 8, and then the toner image on the surface of the photosensitive object 8 is transferred onto the transfer sheet at the position of the transfer roller 14 mentioned above. Thereafter, the transfer sheet is forwarded to a fixing portion (not shown), and then the toner is melted and adheres to the transfer sheet by heat and pressure and the transfer sheet is copied and sent out.

The remaining toner which remains on the photosensitive object 8 is scratched and removed by the cleaning blade 16, and thereafter, the remaining electric charge of the photosensitive object 8 is eliminated by the electric-charge-elimination light 32 so as to make the photosensitive object 8 in a purely white state in which the remaining toner is completely removed therefrom. Thereby, the imaging operation can be repeated.

Figure 2:
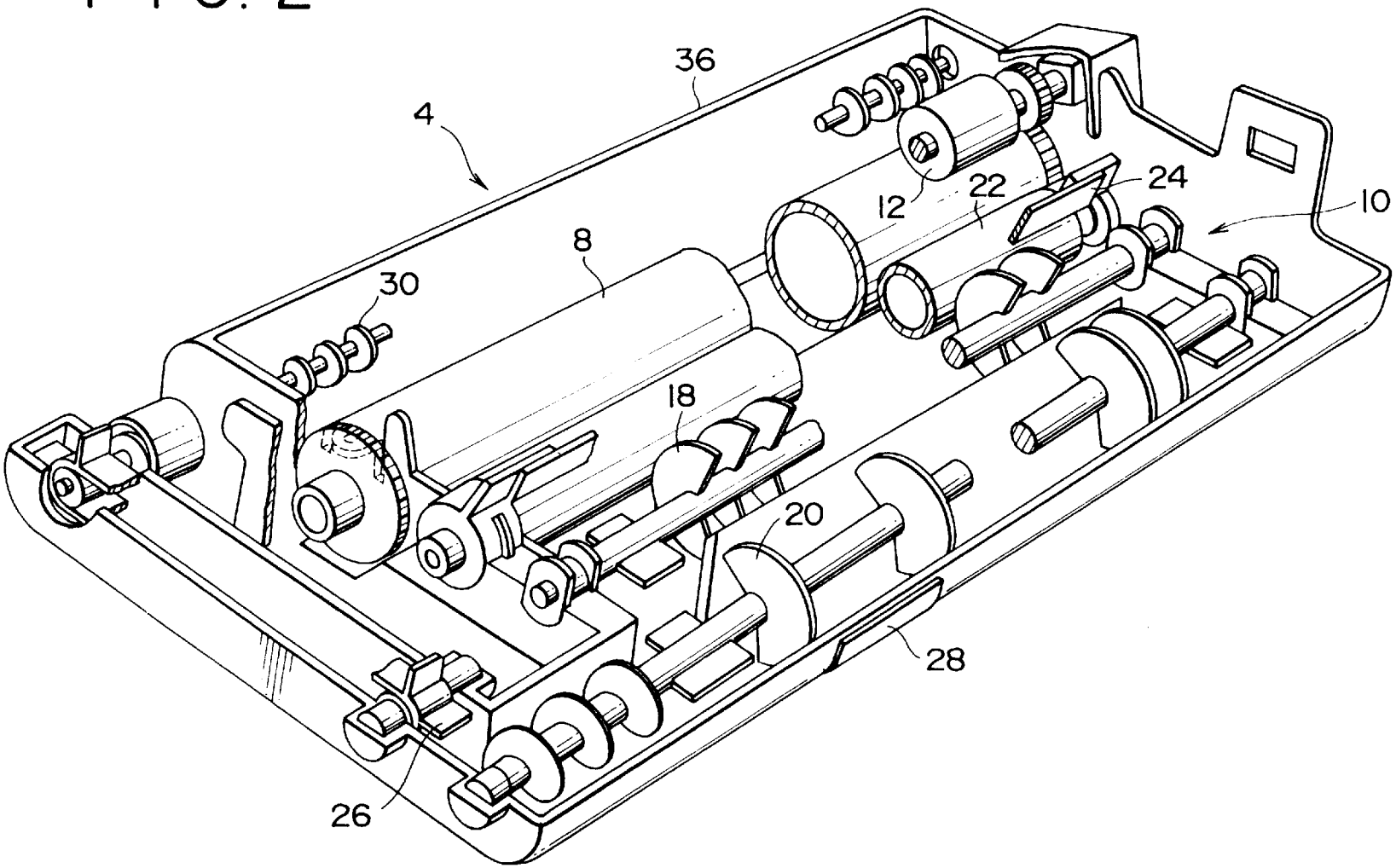
FIG. 2 is perspective view of an internal construction of a process cartridge.

The photosensitive object 8, the charged roller 12, the developing unit 10, the cleaning blade 16, etc. mentioned above are enclosed in a photosensitive-object enclosing case as a single formative member. The layout is shown in FIG. 2 as a perspective view. The remaining toner which has been scratched and removed from the photosensitive object 8 by the cleaning blade 16 is carried to the position of the toner recycling belt 26 by a toner carrying coil 30 which is disposed parallel to the photosensitive object 8, and then it is sent to a place for agitating a developing solution in which the agitating screws 18, 20 is disposed by the toner recycling belt 26. Accordingly, this mechanism allows toner to be recycled.

In the following, there is described the developing unit 10.

The development sleeve 22 has a fixed axis inside which a magnet of 5 poles is arranged, and also, the outside circumference side thereof is covered by pipe material of non-magnetism. The developing solution is moved on the development sleeve 22 by rotating the pipe material. Herein, the developing solution is a two-ingredient type which consists of a small iron ball (called a carrier) and toner. The developing solution circulates while being agitated by the agitating screws 18, 20, and thereby the toner is charged electrically and then carried to the surface of the photosensitive object 8 while adhering to the carrier. As a result, the toner becomes possible to adhere to the photosensitive object 8 in an action of electrostatic power. With respect to the developing solution, the carrier keeps circulating, but the toner is consumed by adhering to the image formed area on the photosensitive object 8. For this reason, toner needs to be supplied suitably. Moreover, inferiority or unevenness of the image depth may occur unless the developing solution is supplied in a certain quantity to the photosensitive object 8. Therefore, the doctor braid 24 for regulating the amount of inflow of the developing solution is disposed.

As shown in FIG. 1, the toner supply unit 6 comprises, upon the whole, a toner bottle 38, a toner receiving stand 42 for setting up the toner bottle 38 which is integrated with a toner hopper portion 40 on a side thereof, a bottle holding member 44 which is disposed in the toner hopper portion 40 to rotate integrally with the toner bottle 38, and further, a plurality of extruding members 46 which are disposed in the bottle holding member 44, wherein an opening portion 48 is formed in the toner hopper portion 40, and a member 50 for regulating the supply quantity is disposed on the outside surface of the opening portion 48 and has elasticity for correcting the supply quantity of toner, and further, a toner introducing cover 52 is disposed outside the opening portion 48 and a toner supplying port 54 is formed to open in the horizontal direction at the lower end of the toner introducing cover 62.

In the process cartridge 4, a toner receiving port 56 is formed to open in the horizontal direction above the agitating screw 20 of the developing unit 10, and then the toner supplying port 54 and the toner receiving port 56 face with each other when the process cartridge 4 and the toner supply unit 6 are mounted in the image forming apparatus body.

As shown by arrow A, the toner flows into the toner hopper portion 40 from a port portion 38*a* of the toner bottle 38 when the toner bottle 38 is rotated. Thereafter, the toner is pushed up in the direction of arrow B by the extruding members 46 of the bottle holding member 44 as the toner bottle 38 is rotated, and then flows in the direction of arrow C through the opening portion 48 to come into the toner introducing cover 52. Next, as shown by arrow D, the toner is supplied into the developing unit 10 through the toner supplying port 54 and the toner receiving port 56 which are connected with each other. Herein, the toner supplying port 54 and the toner receiving port 56 can be opened and closed by a shutter member mentioned later.

Next, there is described the toner supply unit 6 based on FIG. 3 to FIG. 8.

Figure 3:
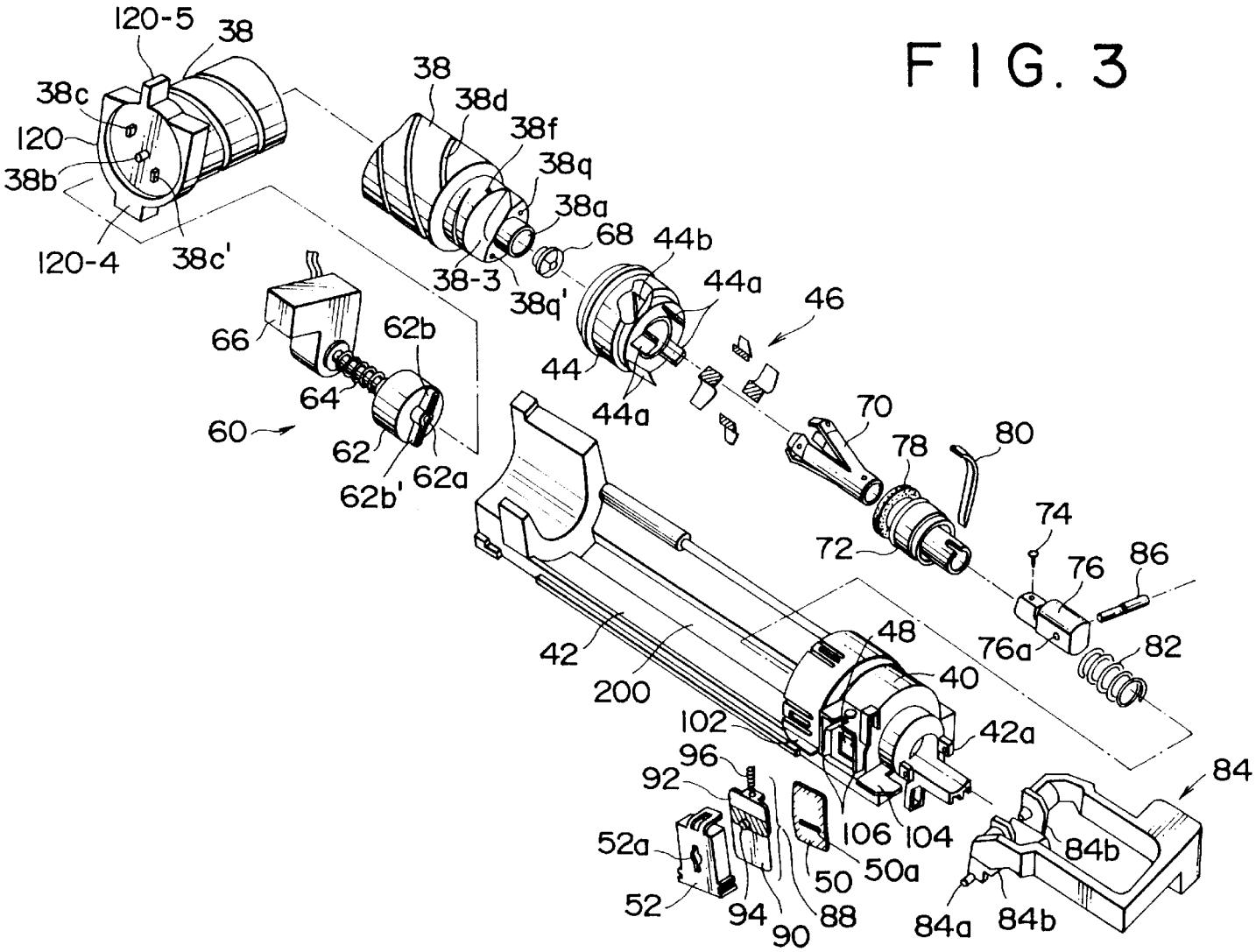
FIG. 3 is in exploded perspective view of a toner supply unit.

FIG. 3 shows parts of which the toner supply unit 6 consists. The toner bottle 38 is driven to rotate by a drive portion 60 which is fixed in a rear plate 58 (see FIGS. 5, 6 and 8) of the image forming apparatus body. The drive portion 60 consists of a joint 62, a spring 64, a case portion 66 having a motor and an axis inside thereof. A concave portion 62*a* and convex portions 62*b*, 62*b*′ for being engaged with a cylinder are formed in the end part of the joint 62. In the lower part (the rear end) of the toner bottle 38*a*, as counterparts of those, there are formed a center 38*b* having a cylindrical convex portion for being engaged with the concave portion 62*a* of the joint 62, and projections 38*c*, 38*c*′ in the axial direction having square-pillar convex portions for being engaged with the side surfaces of the convex portions 62*b*, 62*b*′. The bottom part of the toner bottle 38 is held by engaging the center 38*b* with the concave portion 62*a*, and further, the toner bottle 38 is rotated by engaging the axial-direction projections 38*c*, 38*c*′ with the convex portions 62*b*, 62*b*′. As shown in FIG. 6, when the joint 62 of the drive portion 60 is rotated in the direction of arrow E, the toner bottle 38 is rotated in the same direction thereas.

A spiral groove 38D (see FIG. 22) is formed from the bottom to the port portion in the inside wall of the toner bottle 38, and is equivalent to the spiral groove 38*d* in the outside circumference thereof. The toner is discharged from the port portion 38*a* through the spiral groove 38D when the toner bottle 38 is rotated. A cap 68 for preventing the toner from being discharged while the toner is not in operation is disposed attachably and removably in the port portion 38*a*.

In the end side of the bottle holding member 44, a plurality of ribs 44*a* are formed integrally therewith, and the extruding members 46 are stuck on the ribs 44*a* by a both-side tape, etc. Herein, the extruding members 46 consist of elastic material, such as MAIRA, rubber, or the like. A rib 44*b* is formed in the part opposite to the end part of the middle of the toner bottle 38 on the inside wall of the bottle holding member 44.

A middle portion 38-3 with the middle-sized diameter 13 formed between a cylindrical body portion with the largest diameter of the toner bottle 38 and the narrowed port portion 38*a* with the smallest diameter, and drive claws 38*q*, 38*q'* are formed in the end surface of the middle portion 38-3, a so-called shoulder portion, on the side of the port portion 38*a*. The drive claws 38*q*, 38*q'* are hooked by the rib 44*b* so that the bottle holding member 44 is rotated by rotation of the toner bottle 38.

In FIG. 3, reference character 70 designates a collecting chuck for holding and releasing the cap 68, and the collecting chuck 70 is placed inside a cylindrical case 72 and is connected with an axial member 76 by a screw 74. Reference character 78 designates seal material, 80 designates a seal member, and 82 designates a coil spring with which a series of parts such as the collecting chuck 70, the cylindrical case 72, the axial member 76 and such are in a state of being pressed toward the toner bottle 38. These mounted parts are held in a toner hopper portion 40. Reference character 84 designates a handle for opening or closing the port portion 38*a* by moving the cap 68, and an axial portion 84*a* formed integrally therewith is held rotatably on a hole 42*a* through which an axis is passed. Herein, the hole 42*a* is formed in the end part of the toner receiving stand 42.

Reference character 86 designates a slide axis formed in the axial member 76, which is inserted into a hole 76*a*. Herein, the slide axis 86 is in contact with a cam portion 84*b* which is formed in the handle 84. When the handle 84 is rotated in direction F shown in FIG. 5 and FIG. 6 and then the series of parts such as the collecting chuck 70 and the like are slid in the direction farther away from the toner bottle 38, the cap 68 is removed from the port portion 38*a* so that the toner in the toner bottle 38 can be discharged from the toner hopper portion 40. This mechanism will be described in details later.

Next, there will be described a shutter member and the like for opening or closing the toner supplying port 54 shown in FIG. 1.

As shown in FIG. 3, a member 50 for regulating the supply amount which is disposed in the opening portion 48 of the toner hopper portion 40 has a slit hole 50*a* (a hole which has been cut into a long and narrow square). Herein, the member 50 is made of elastic material such as MAIRA, rubber, or the like. The amount in which toner is supplied is made proper by the width of the slit hole 50*a* which is adjustable The supply-amount regulating member 50 is stuck on the opening portion 48 by a both-side tape, etc.

Inside the toner introducing cover 52 which is disposed outside the opening portion 48, a shutter member 88 for opening or closing the toner supplying port 54 (see FIG. 4) is disposed movably in the upward and downward directions, that is, in a perpendicular state (an intersectional state) to the toner supplying port 54 which is opened horizontally. Herein, the shutter member 88 consists of an elastic member 90 as a shutter body which can be incurvated, a holding member 92 for holding the elastic member 90, and a cylindrical projection 94 which is formed integrally with a holding member 92. The holding member 92 has a spring member 96 whose stress allows the shutter member 88 to be kept closed. In this embodiment, the elastic member 90, which is made of a polyester film such as MAIRA, etc. is stuck on the holding member 92 by a both-side tape, etc. A hole 52*a* within which the projection 94 is moved is formed in the toner introducing cover 52.

Figure 4:
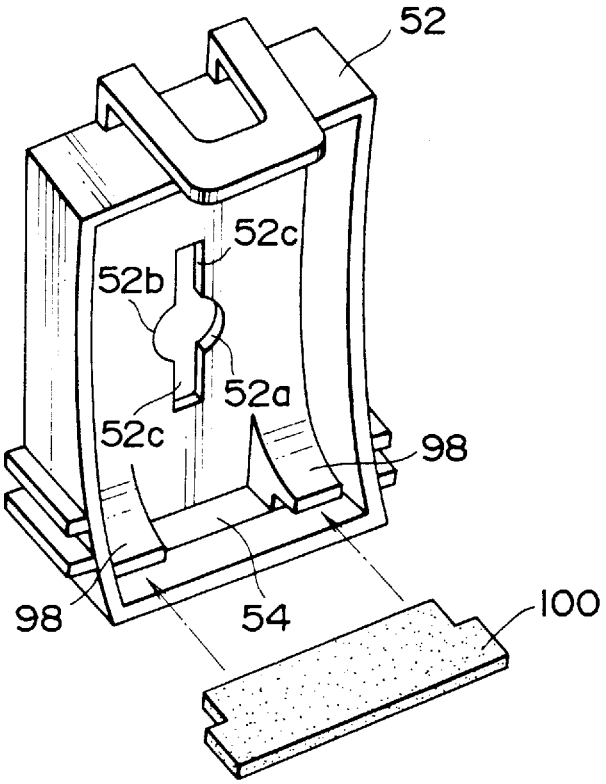
FIG. 4 is an exploded perspective view of a toner introduction cover.

In the toner introducing cover 52, as shown in FIG. 4, the toner supplying port 54 is formed in the bottom surface thereof, and circular guiding portions 98, 98 for guiding the elastic member 90 of the shutter member 88 is formed integrally therewith. A sponge seal member 100 as an elastic seal member for preventing toner from scattering is disposed by fitting the end of the elastic member 90 into the end of the guiding portion 98.

Reference character 104, which is shown near the opening portion 48 in FIG. 3, designates a second guiding rib for driving a second shutter member mentioned later, which protrudes in the shape of a trapezoid in the longitudinal direction. Reference character 106 designates a guide for regulating deformation which holds the back side of the elastic member 90.

Figure 5:
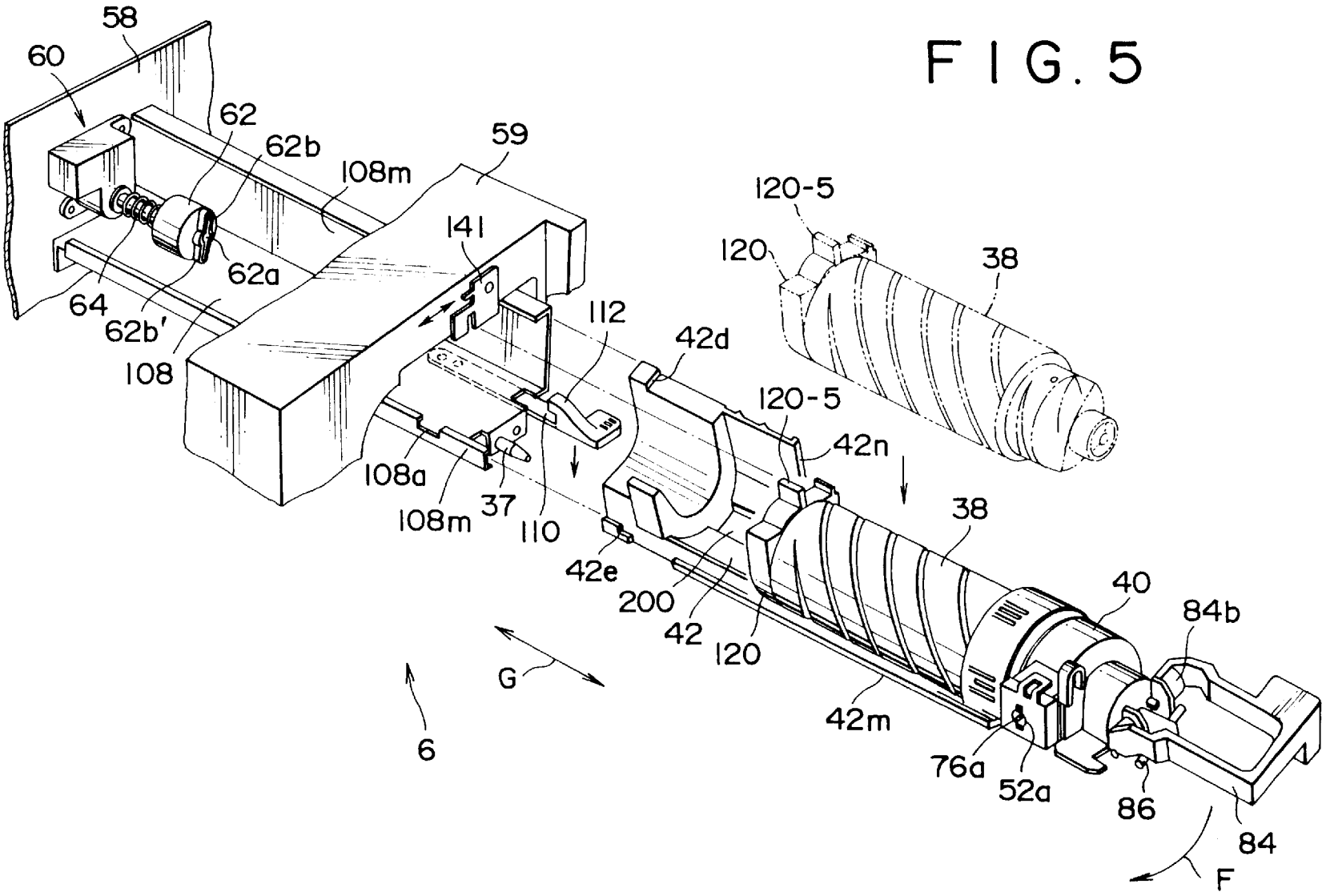
FIG. 5 is a perspective view of a toner receiving stand and a guide plate the side of an apparatus body.
Figure 6:
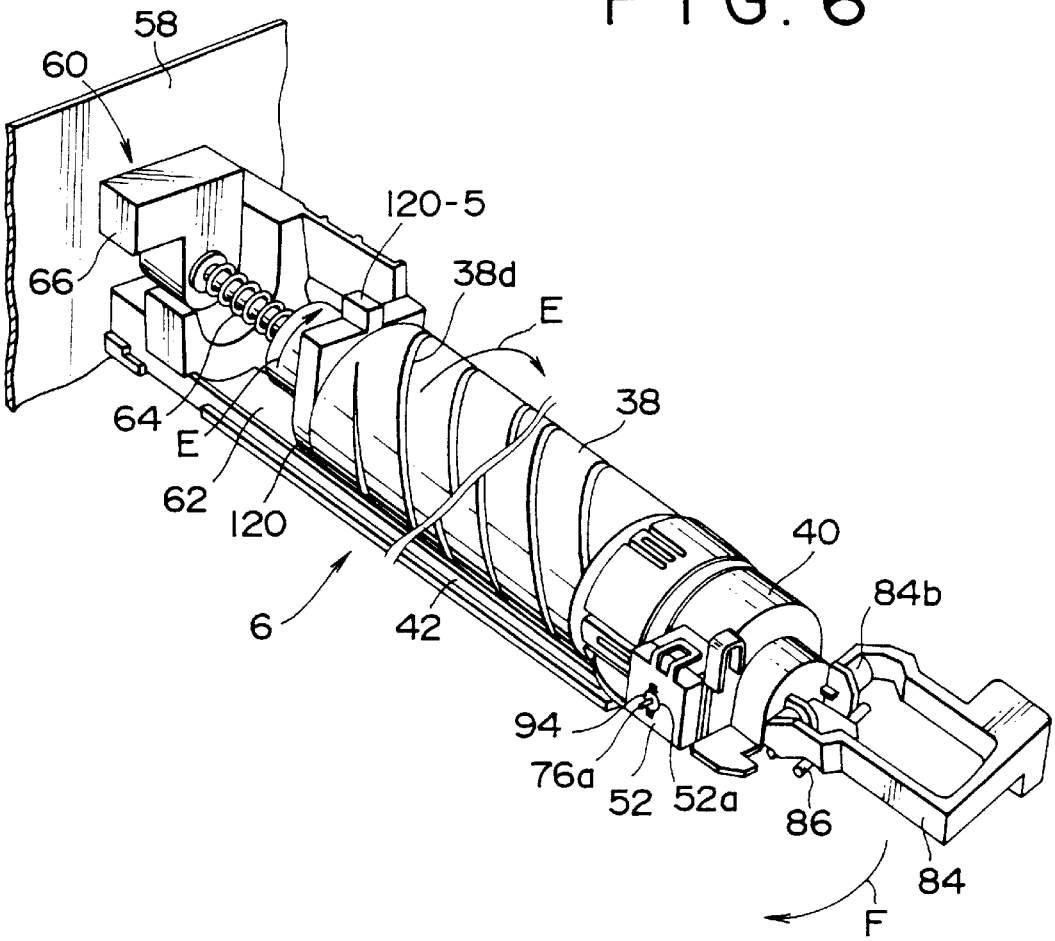
FIG. 6 is a perspective view of the toner supply unit to which a toner bottle is attached.
Figure 7:
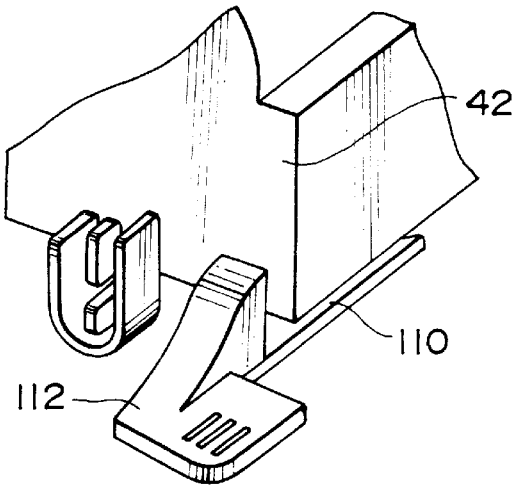
FIG. 7 is a perspective view of the receiving stand held by a stopper.

As shown in FIG. 5, the toner receiving stand 42 can be attached or detached freely in the directions of arrow G by being guided on a guide plate 108, and the guide plate 108 is fixed on a rear plate 58 and a front plate 59 of the apparatus body with screws (not shown). At the end of the guide plate 108, a stopper 112 for avoiding removal which is held a plate spring 110 fixed thereon is disposed. The toner supply unit 6 is attached in a state in which the stopper 112 has been pushed downward, and thereafter, the stopper 112 is returned to be engaged with the end part of the receiving stand 42. Thereby, the toner supply unit 6 is kept in a fixed state, as shown in FIG. 7.

In FIG. 5, there is shown a state in which the toner supply unit 6 is removed from the guide plate 108. In a state of being counted, side portions 42*m*, 42*n* are engaged with guides 108*m*, 108*n* of the guide plate 108. As shown in FIG. 5, in a state in which the receiving stand 42 has been drawn out, the toner bottle 38 is attached to or removed from the toner supply unit 6. As shown in FIG. 5, a step portion 42*e* formed in the receiving stand 42 is hooked by a notch portion 108*a* formed in the guide plate 108 so that removal can be prevented. A step portion 42*d* is hooked by a notch formed in the guide 108*m*. This notch is not shown in FIG. 5 since being hidden behind the apparatus-body front plate 59.

Figure 8:
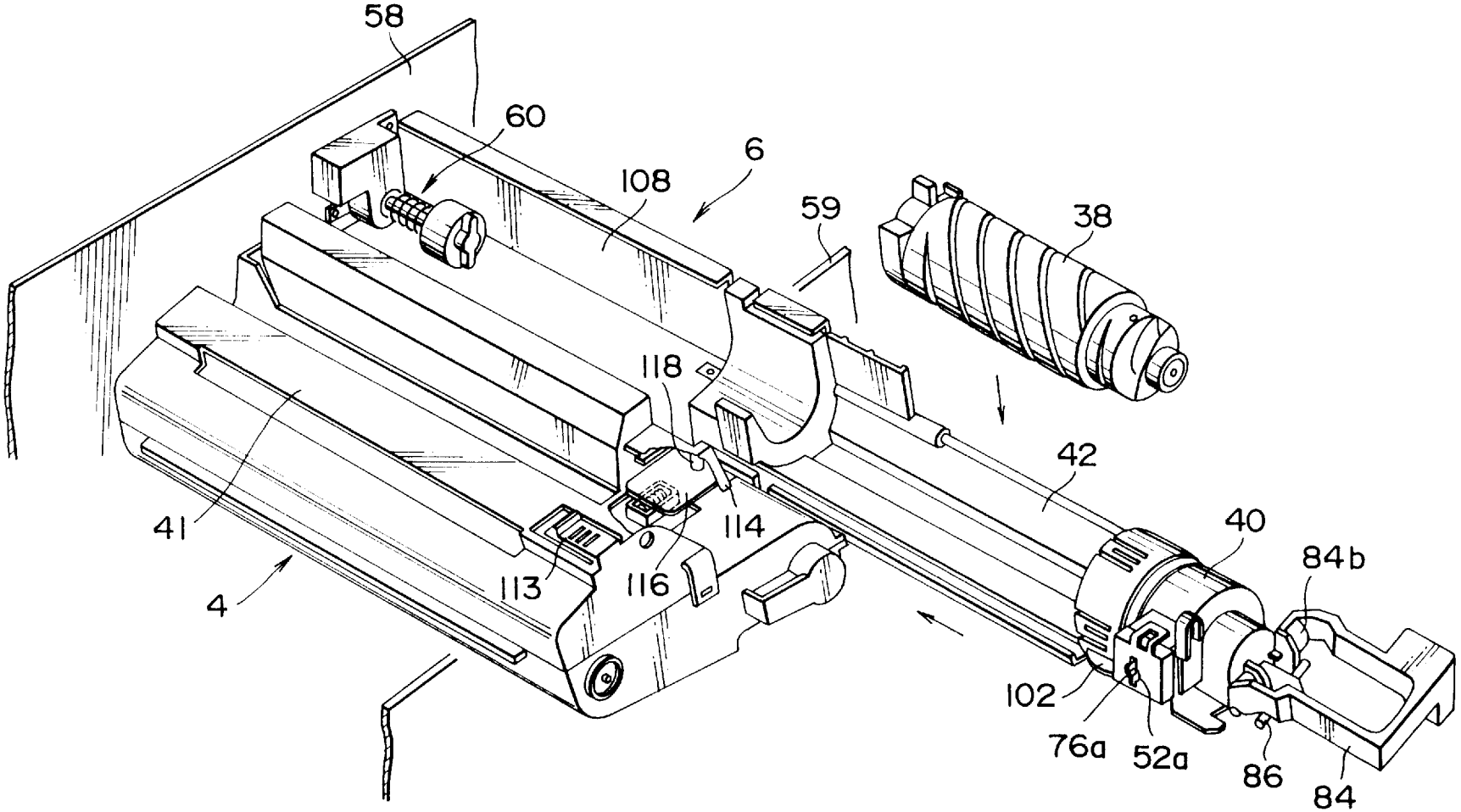
FIG. 8 is a perspective view of the toner supply unit drawn from a body the image forming apparatus.

In FIG. 8, there is shown a state in which the process cartridge 4 has been counted and the toner supply unit 6 has been pulled out. In FIG. 8, the process cartridge 4 is positioned and held by a positioning pin (not shown) which is disposed in the rear plate 58 and the front plate 59 of the apparatus body and also is held not to be removed by a stopper 113 which is formed integrally with a upper case 41.

As shown in FIG. 5, the toner bottle 38 is placed on the receiving stand 42, and the toner supply unit 6 is pushed and set up into the apparatus body. Before that, there is kept a state in which the toner supplying port 54 which is formed in the bottom part of the toner introducing cover 52 has been closed with the shutter member 88 by the stress of the spring member 96, and the elastic member 90 is incurvated along the circular guiding portion 98 and the end thereof cuts into the sponge seal member 100. Thus, a seal is attached between the opening portion 48 of the toner hopper portion 40 and the toner supplying port 54 so that the toner can be prevented from leaking from therebetween.

When the operation of pushing the toner supply unit 6 into the apparatus body is carried out in the aforementioned state, the shutter member 88 goes upward (moves aside) into a perpendicular state, and sequentially, the toner supplying port 54 is opened so that the developing unit 10 is linked to the toner supply unit 6. Next, the toner supply unit 6 is pulled out, and then the shutter member 88 goes downward and is incurvated along the toner supplying port 54 in the perpendicular state. Consequently, the toner supplying port 54 becomes a state of being closed.

Hereinafter, there will be described a shutter member and the like with which the toner supplying port 54 is opened or closed.

Figure 9:
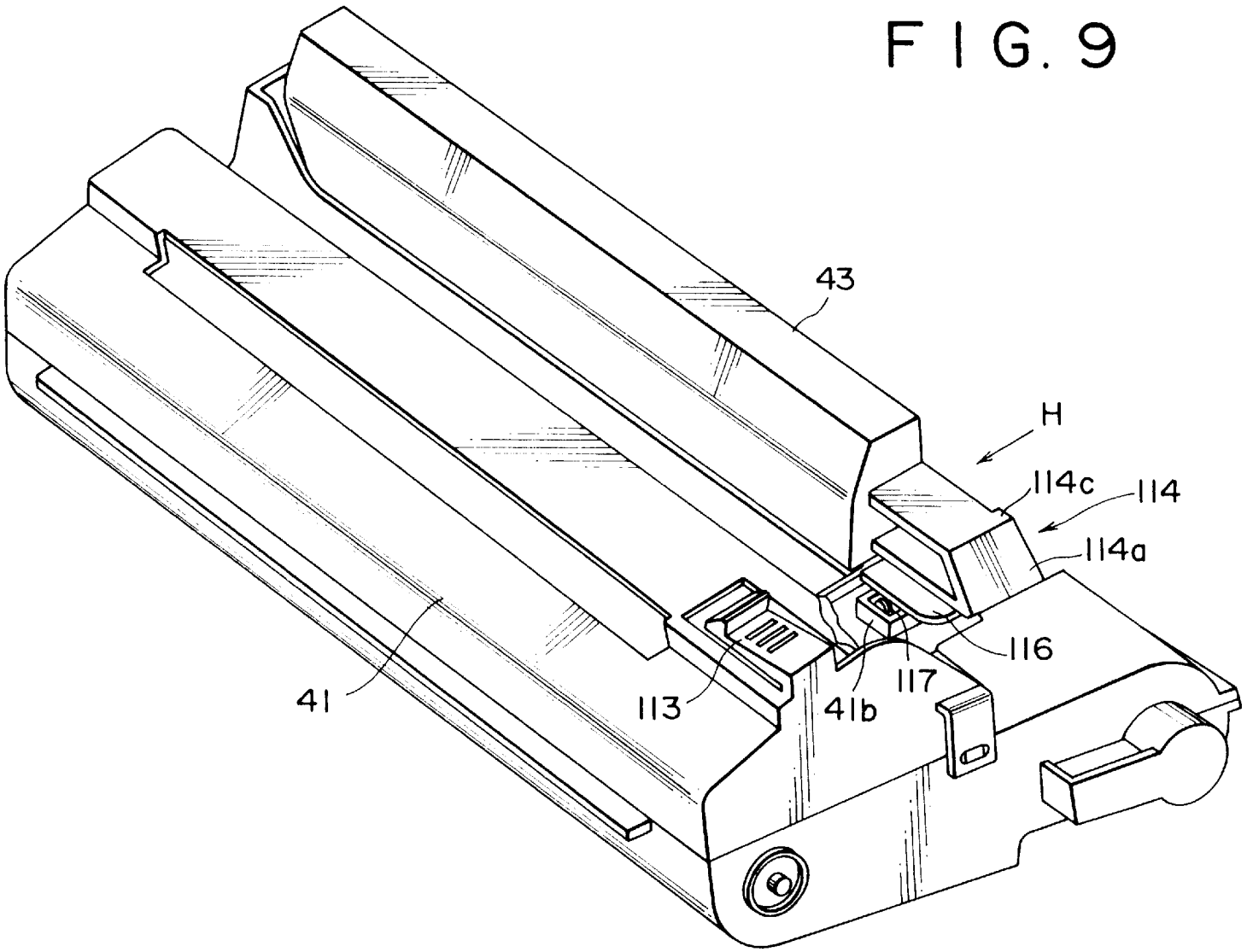
FIG. 9 is a perspective view of the process cartridge.
Figure 10:
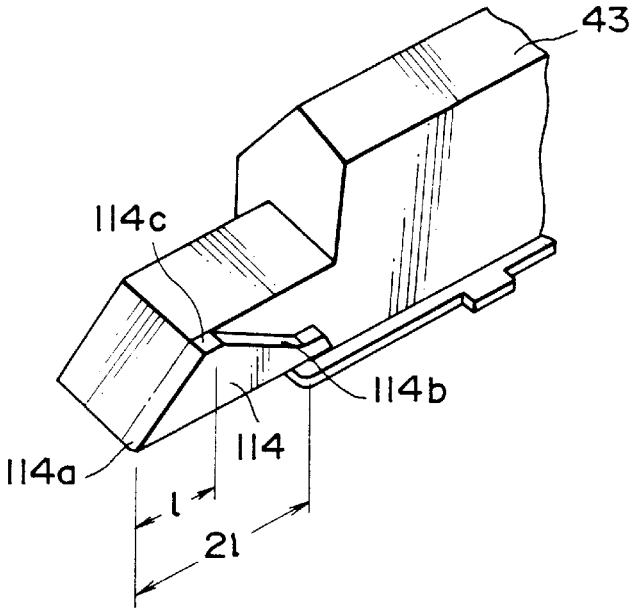
FIG. 10 is a perspective view of a guiding rib seen from the side of arrow H of FIG. 9.

In FIG. 9, reference character 43 designates an upper case of a development portion, and a guide rib 114 which is engaged with the projection 94 and thereby allows the shutter member 88 to be rotated is formed integrally with the development-portion upper case 43. The guide rib 114, as shown in FIG. 10, is formed in the shape of a trapezoid having a projecting part in the perpendicular direction, and the guide rib 114 has inclination sides 114*a*, 114*b*, and a flat top side 114*c*. Herein, FIG. 10 is a side view seen from arrow H of FIG. 9.

Figure 11:
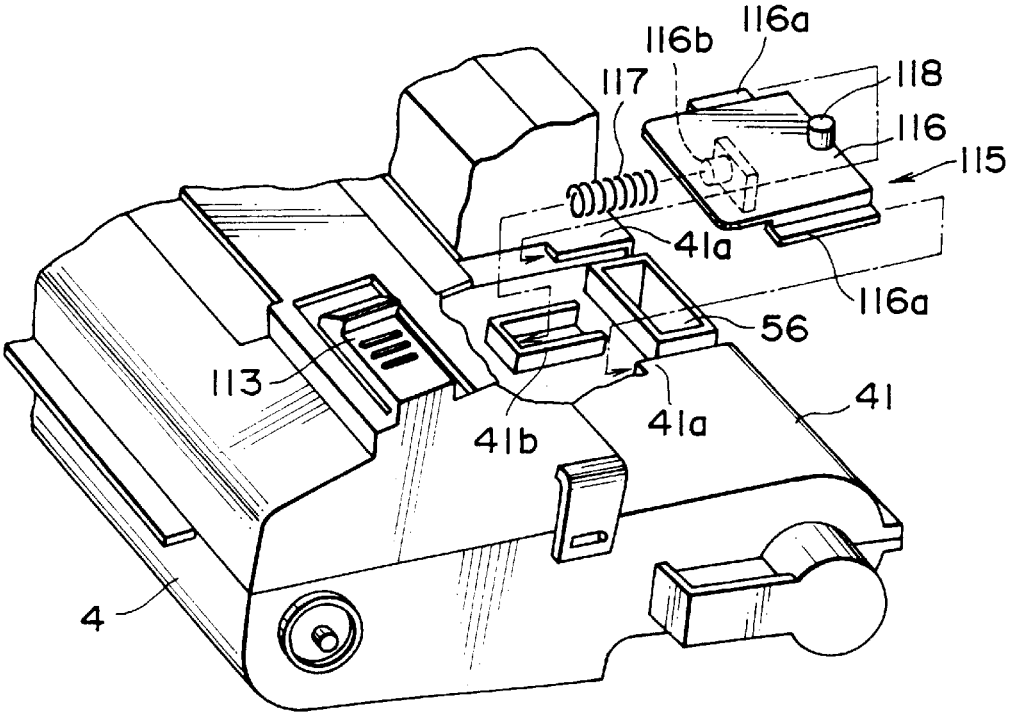
FIG. 11 is an exploded perspective view of a second shutter member and members therearound.

Underneath the guide rib 114, as shown in FIG. 11, a second shutter member 115 for opening or closing the toner receiving port 56 is disposed substantially parallel to the toner receiving port 56. The second shutter member 115 consists of a plate-like shutter body 116 and a spring member 117 whose stress allows the shutter body 116 to be kept closed. A cylindrical second projecting portion 118, which is engaged with the second guiding ribs 102, 104 formed in the toner supply unit 6 and thereby allows the second shutter member 115 to be opened or closed in the longitudinal direction, is formed integrally with the shutter body 116. Slide pieces 116*a* are formed in the both sides of the shutter body 116, on the other hand, guide portions 41*a* with which slide pieces 116*a* are engaged is formed in the upper case 41. Thereby, the shutter body 116 slides longitudinally on the upper case 41. Further, in the under surface of the shutter body 116, a boss 116*b* which supports an end of the spring member 117 is formed integrally therewith, the other end of the spring member 117 is supported by a rib 41*b* in a square-U shape which is formed in the upper case 41.

Figure 12A:
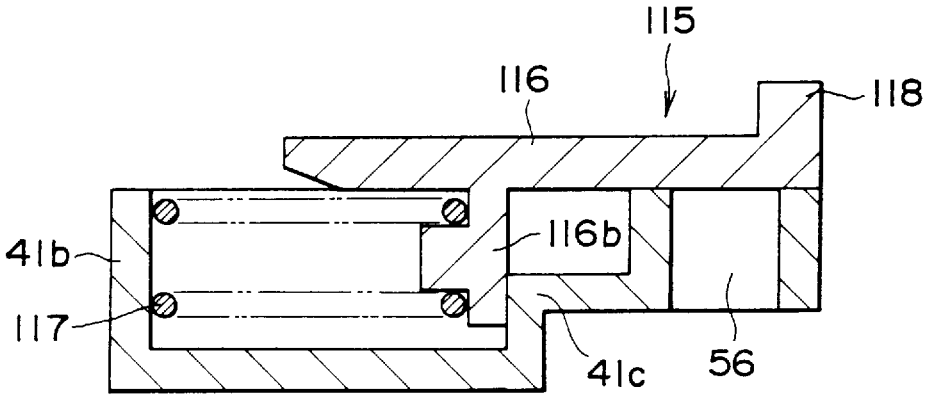
FIG. 12(*a*) is a sectional view of the second shutter member, showing a state in which the second shutter has been closed.
Figure 12B:
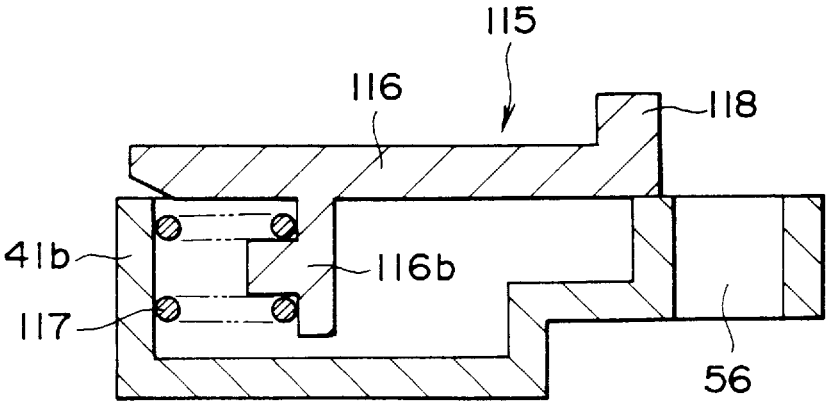

In a state in which outside force does not act on the second projecting portion 118, in other words, a state in which the toner supply unit 6 is mounted in a predetermined position, the stress of the spring member 117 allows the shutter body 116 to be projected so that the toner receiving port 56 is closed. The position until which the shutter body 116 is projected is determined by the contact of the boss 116*b* with a step portion 41*c*. When the outside force acts on the second projecting portion 118, as shown in FIG. 12(*b*), the shutter body 116 is retreated against the stress of the spring member 117 so that the toner receiving port 56 is opened.

Figure 13A:
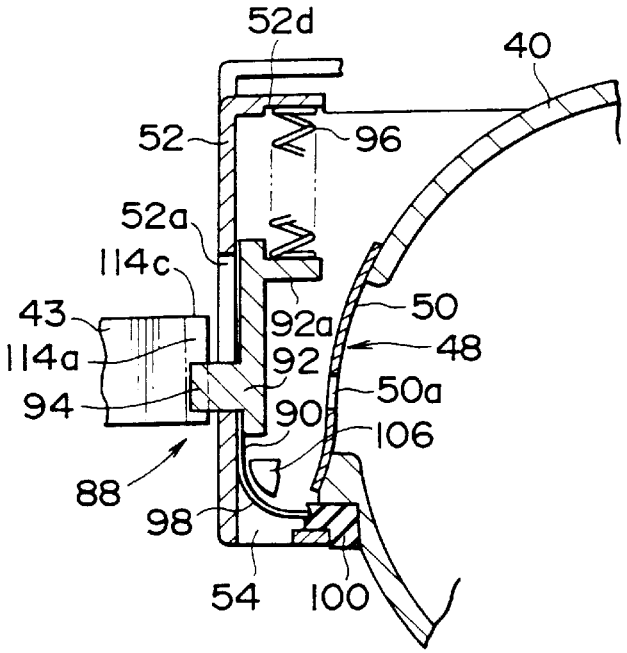
FIG. 13(*a*) is a sectional view of an elastic member, showing a state in which it has been closed.
Figure 13B:
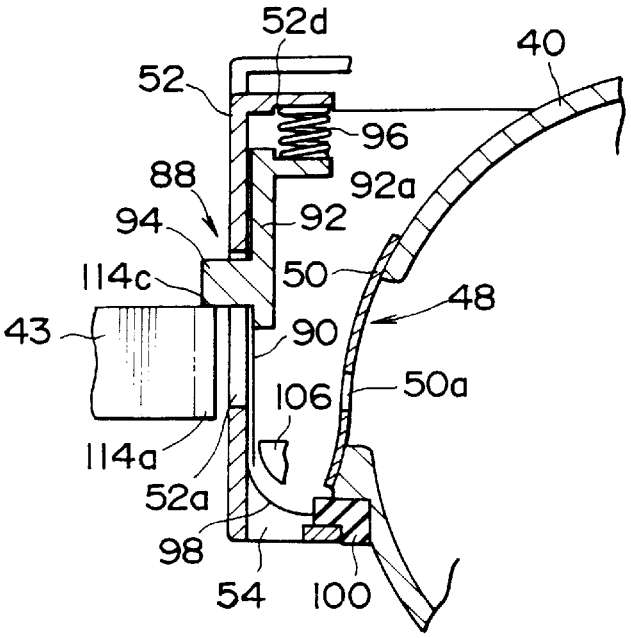

Next, on the basis of FIG. 13 and FIG. 14, there will be described the opening-and-closing operation of the shutter member 88 and the second shutter member 115, respectively.

Beginning with the state shown in FIG. 8, the toner bottle 38 is placed on the receiving stand 42, and then the toner supply unit 6 is pushed and set up into the apparatus body. Therebefore, as shown in FIG. 13(*a*), there is kept a state in which the toner supplying port 54 has been closed with the shutter member 88 by the stress of the spring member 96, and the elastic member 90 is incurvated along the circular guiding portion 98 and the end thereof cuts into the sponge seal member 100. Thus, a seal is attached between the opening portion 48 of the toner hopper portion 40 and the toner supplying port 54 so that the toner can be prevented from leaking from therebetween. In FIG. 13(*a*), reference character 52*d* designates a concave portion for receiving a spring which is formed on the toner introducing cover 52, and 92*a* designates a spring seat which is formed integrated with the holding member 92.

When the operation of pushing the toner supply unit 6 into the apparatus body is carried out in the aforementioned state, the cylindrical part of the projection 94 which is formed integrally with the holding member 92 comes into contact with a inclining side 114*a* of the guide rib 114 which is formed integrally with the development-portion upper case 43. As shown in FIG. 13(*b*), the cylindrical part is pushed upward against the stress of the spring member until reaching and stopping at a flat top part 114*c* of the guide rib 114. Following this movement, the elastic member 90 goes upward (moves aside) along the guiding portion 98 so that the toner supplying port 54 is opened.

The projection 94 is slid downward on the inclining side 114*a* when the toner supply unit 6 is drawn out, and then the shutter member 88 is moved toward the direction of being closed automatically by the stress of the spring member 96. Sequentially, the elastic member 90 is incurvated along the toner supplying port 54 from a perpendicular state and then is brought to a closed state shown in FIG. 13(*b*). In this embodiment, the deformation-regulation guide 106 is disposed on the back side of the elastic member 90 so that the unexpected deformation (waving, etc.) under movement of the elastic member 90 can be prevented, as well as, no more than incurvate deformation which allows the toner supplying port 54 to be opened or closed can be made without fail. Herein, yet, the deformation-regulation guide 106 is not necessarily used.

In this embodiment, there has been described the operation in which the shutter member 88 is opened or closed in the case where the toner supply unit 6 is attached to or removed from the process cartridge 4 which has been mounted in the apparatus body. Herein, the guide rib 114 is formed in the shape of a trapezoid, and thus, opening-or-closing operation of the shutter member 88, which is similar to the aforementioned operation, can be made in each cases where the toner supply unit 6 or the process cartridge 4 is attached to or removed from the apparatus body, regardless of the order by which each of the attachment-or-removal operations is carried out. Thereby, in each cases where the toner supply unit 6 or the process cartridge 4 is removed from the apparatus body, the shutter member 88 is closed. Thus, the toner can be prevented from scattering.

Figure 14A:
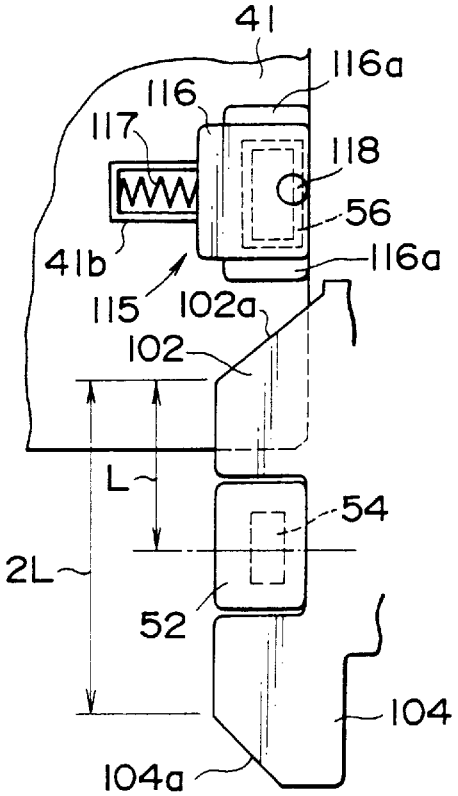
FIG. 14(*a*) is a sectional view of the second shutter member, showing a state in which it has been closed.
Figure 14B:
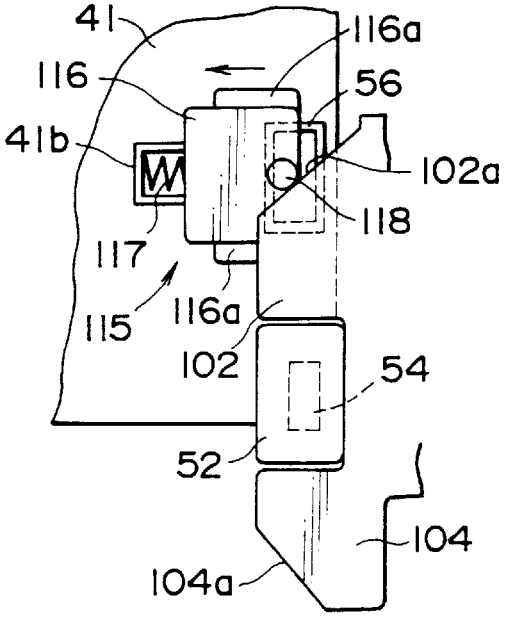
Figure 14C:
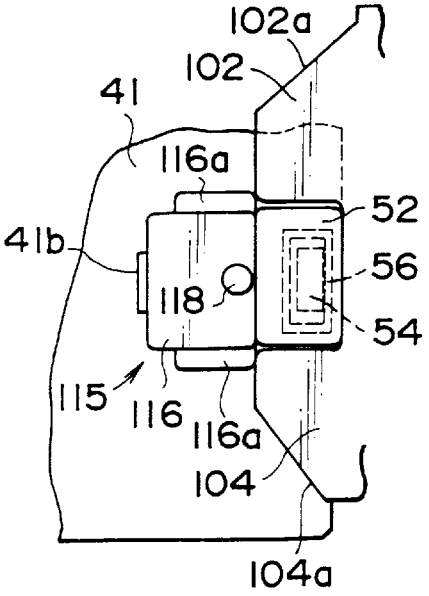

On the other hand, when the toner supply unit 6 is pushed in, as shown in FIG. 14(*a*), the cylindrical second projecting portion 118 comes in contact with a inclining side 102*a* of a second guide rib 102 which is formed to protrude in the longitudinal direction in the receiving stand 42 of the toner supply unit 6. As shown in FIG. 14(*b*), the second shutter member 115 is moved aside from the closed state thereof in the longitudinal direction against the stress of the spring member 117. Thereafter, the toner receiving port 56 is opened fully at the time that the second projecting portion 118 passes through the inclining side 102*a*, and then the toner receiving port 56 and the toner supplying port 54 face to each other when the second projecting portion 118 reaches at the central part of the side of the toner introducing cover 52 (see FIG. 14(*c*)). Since both of the operations in which the second shutter member 115 is opened, and the shutter member 88 is opened, occur simultaneously, the developing unit 10 and the toner supply unit 6 are connected to each other.

The second guide ribs 102, 104 have a separation form in which the toner introducing cover 52 is disposed in the middle part thereof. Nonetheless, the second guide rib 102 practically has a function similar to the guide rib 114 since having an inclining side 104*a* with which the inclining side 102*a* is symmetrized. As a consequence, the order by which the process cartridge 4 and the toner supply unit 6 is attached to or removed from the apparatus body therebetween even in the operation where the second shutter member 115 is opened or closed.

In the second guide ribs 102, 104 which is disposed in the toner supply unit 6, reference character L designates a distance between the central point of the toner supplying port 54 and the end point of the inclining side (see FIG. 14(*a*)). On the other hand, in the guide rib 114 which is disposed in the development-portion upper case 43 of the process cartridge 4, reference character l designates a length of the inclining side 114*a* in the attachment-or-removal direction (see FIG. 10). Herein, the relation between L and l are determined to become L>l, and thereby the shutter member 88 is opened or closed on the side of the toner supplying port 54 in a state in which the second shutter member 115 on the side of the toner receiving port 56 is kept opened.

Figure 15:
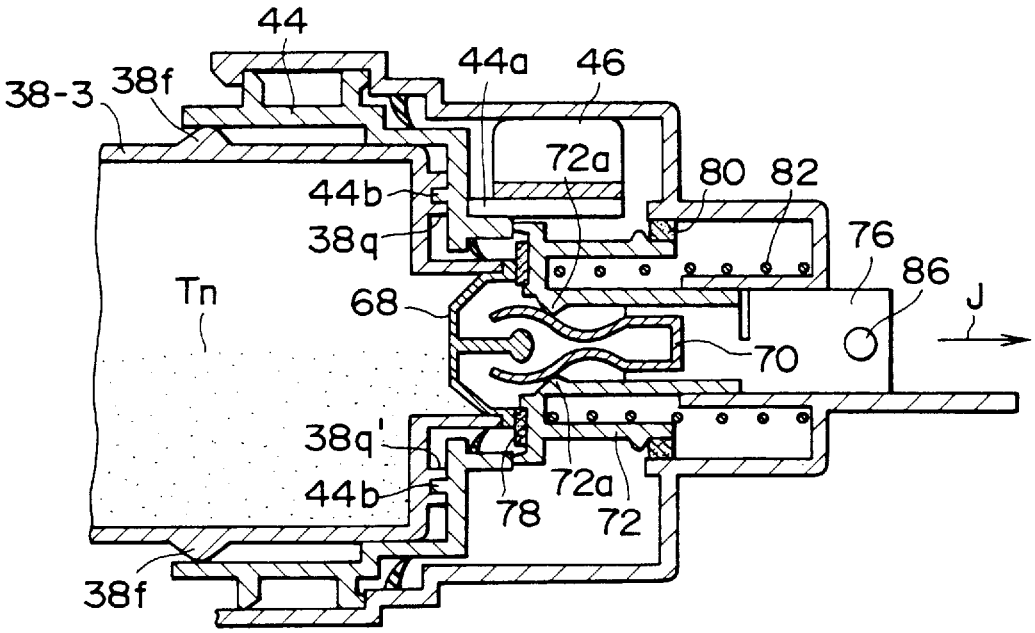
FIG. 15 is a sectional view showing a state in which a cap of the toner bottle held by a bottle holding member is in engagement.

Next, there will be described a mechanism in which toner is supplied from the toner supply unit 6 to the process cartridge 4. FIG. 15 shows a state in which both of the toner supplying port 54 and the toner receiving port 56 is opened, that is, the toner supply unit 6 and the process cartridge 4 is attached to the apparatus body. As shown in FIG. 15, a small globular projection 38*f* is formed in the middle portion 38-3 (see FIG. 3) of the toner bottle 38. The small projection 38*f* is engaged with the inner circumference of the bottle holding member 44, and then the end surface of the toner bottle 38 is engaged with the rib 44*b* of the bottle holding member 44. Thereby, the toner bottle 38 is positioned over the toner hopper portion 40.

In this state, the slide axis 86 is pulled in the direction of arrow J shown in FIG. 15 by the cam portion 84*b* (see FIG. 3) when the handle 84 is rotated downward in the direction of arrow F shown in FIG. 5 and FIG. 6. Thereby, the axial member 76 is moved in the direction of arrow J, and then the collecting chuck 70 comes into contact with a projection 72*a* of the cylindrical case 72 and begins to be closed so as to collect the cap 68. When more movement in the direction of arrow J is made, as shown in FIG. 15, the cap 68 of the toner bottle 38 is removed by the collecting chuck 70 so that toner Tn in the toner bottle 38 can be flown into the toner hopper portion 40 which is mounted on the toner receiving stand 42.

Toner supply is made on the basis of the toner density inside the developing unit 10 which is detected by the toner density sensor 28 (FIG. 1). First, the drive portion 60 begins to operate and rotates the joint 62 in the direction of arrow E when a detected value becomes below a predetermined density, as shown in FIG. 6. Thereby, the joint 52 becomes engaged with the bottom part of the toner bottle 38, and then the toner bottle 38 is also rotated in the direction of arrow E. The toner is discharged from the port portion 38*a* and is accumulated in the toner hopper portion 40 when the toner bottle 38 is rotated. On the other hand, the drive claws 38*q*, 38*q*′ which are formed on the end side of the port portion side of the middle portion 38-3 of the toner bottle 38 becomes engaged with and pushes to move the rib 44*b* which is formed integrally with the bottle holding member 44 by the rotation of the toner bottle 38. Therefore, the extruding member 46 which is formed integrally with the bottle holding member 44 is rotated rubbing on the inner wall of the toner hopper portion 40. The toner Tn which remains inside the toner hopper portion 40 is scratched up by the rotation of the extruding member 46.

When the extruding member 46 passes through a slit hole of the supply-quantity regulating member 50, the toner is pushed out of the slit hole, and then the toner falls inside the toner a introducing cover 52 and passes through the toner supplying port 54 and the toner receiving port 56 which are located in the lower part in a open state, and finally, the toner is supplied into the developing unit 10.

Next, on the basis of FIG. 17 to FIG. 30, there will be described in details the toner bottle according to this invention.

In FIG. 17 to FIG. 24, there is described a basic construction of the toner bottle according to this invention, and in FIG. 17 to FIG. 24, there is described the toner bottle which has a member such as a ring in order to raise use value thereof, in addition to the basic construction of the toner bottle.

Figure 17:
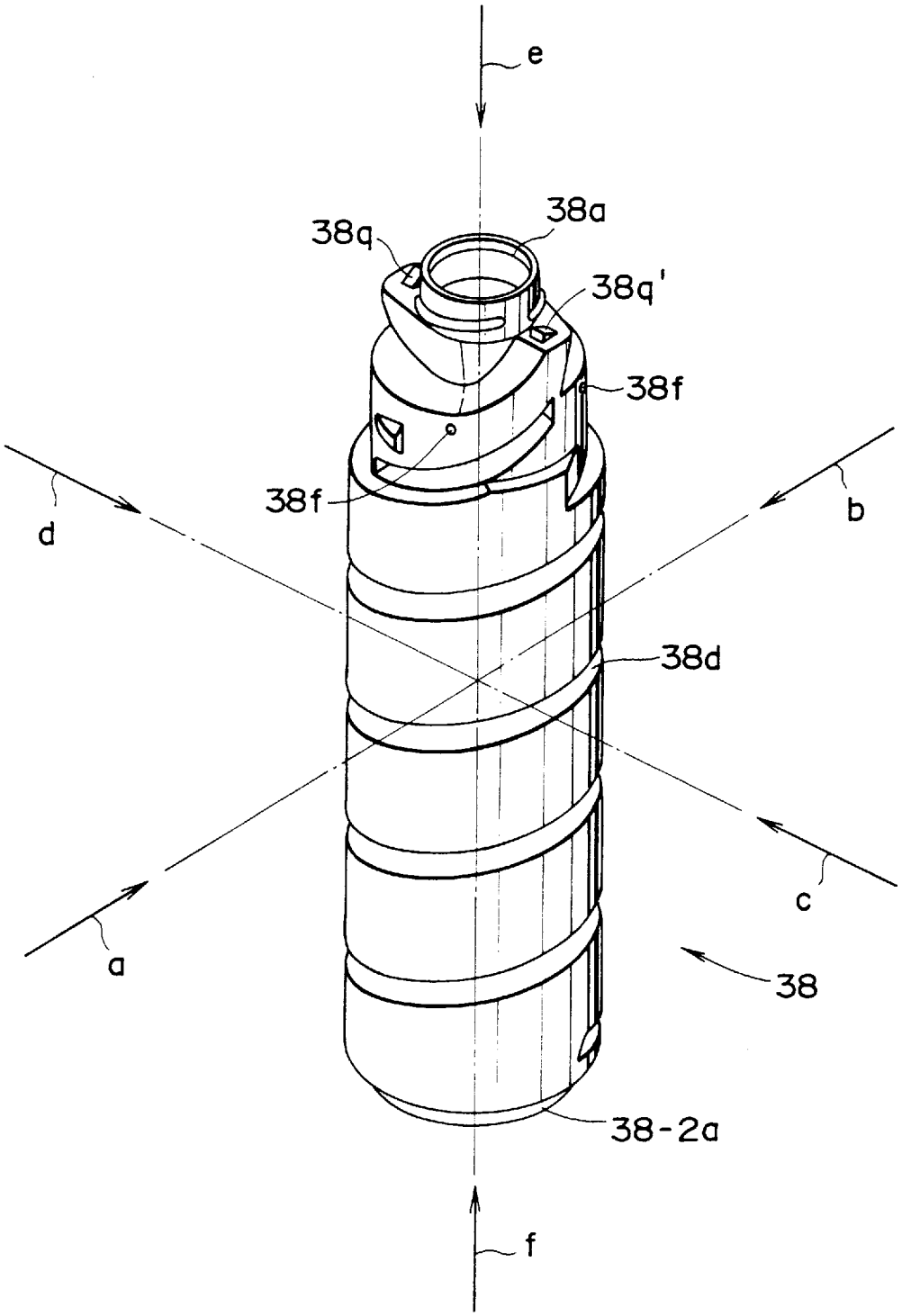
FIG. 17 is a perspective view of the toner bottle.
Figure 18:
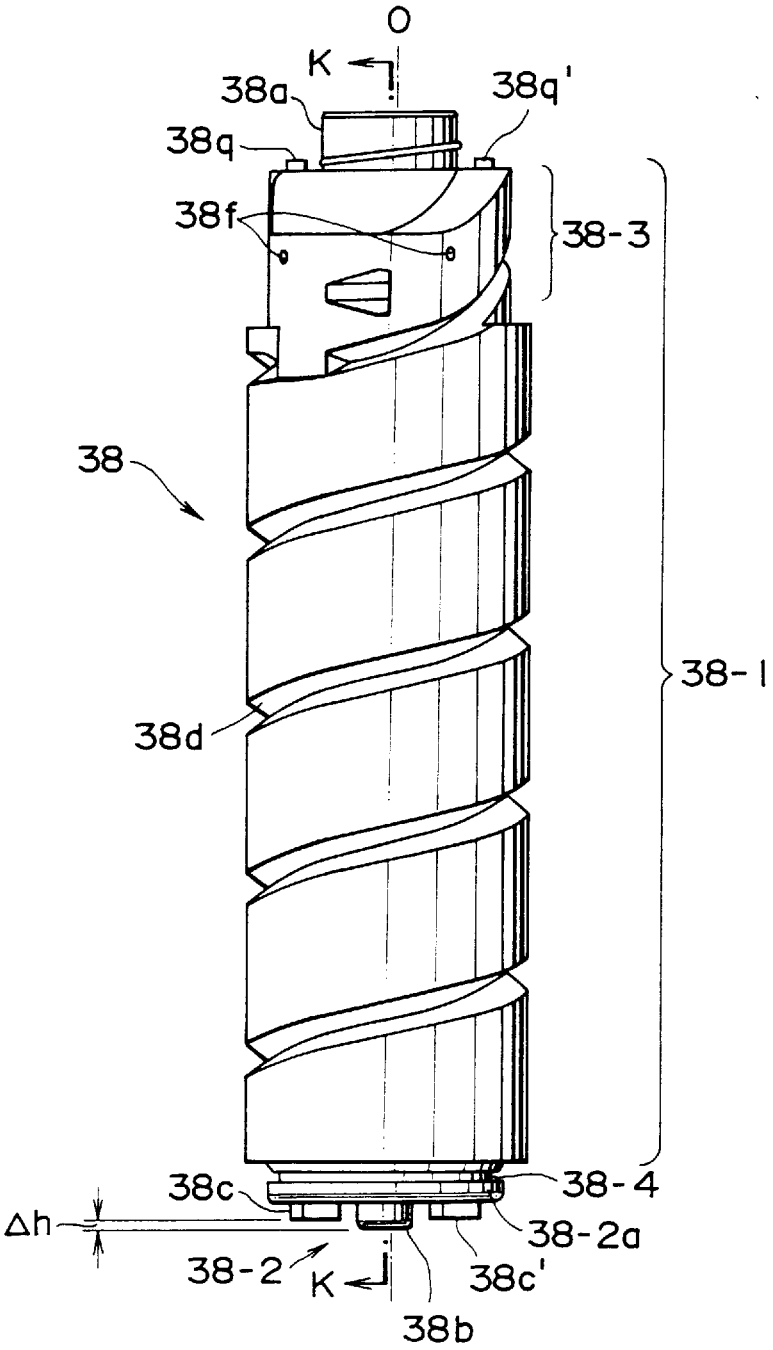
FIG. 18 is a front view of the toner bottle.
Figure 19:
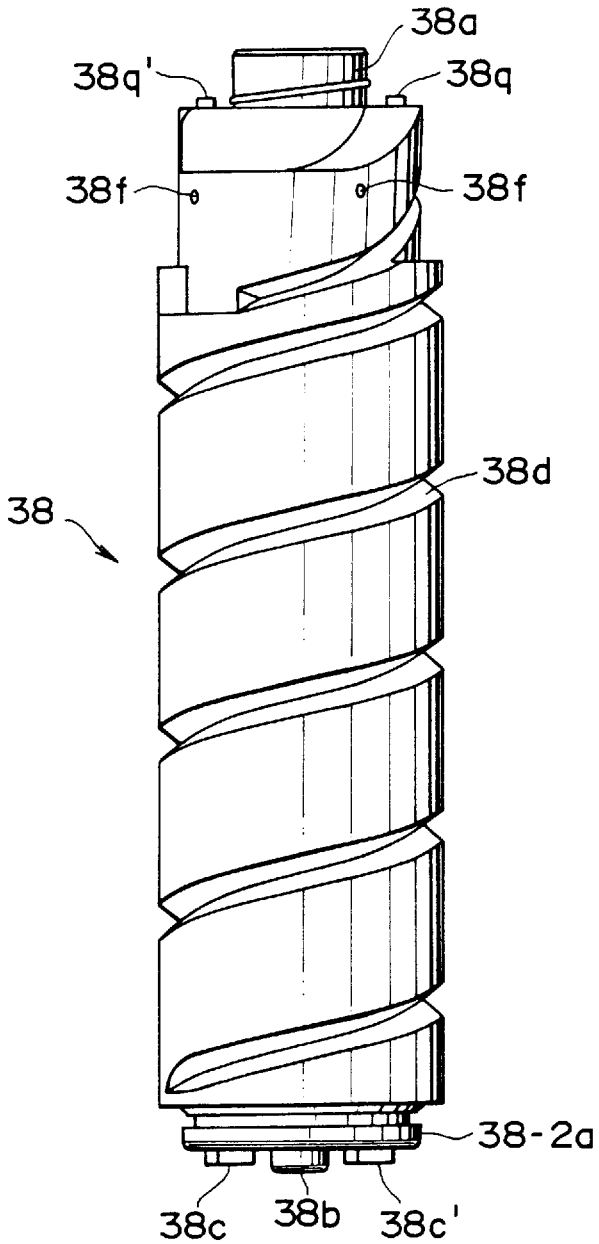
FIG. 19 is a back view of the toner bottle.
Figure 20:
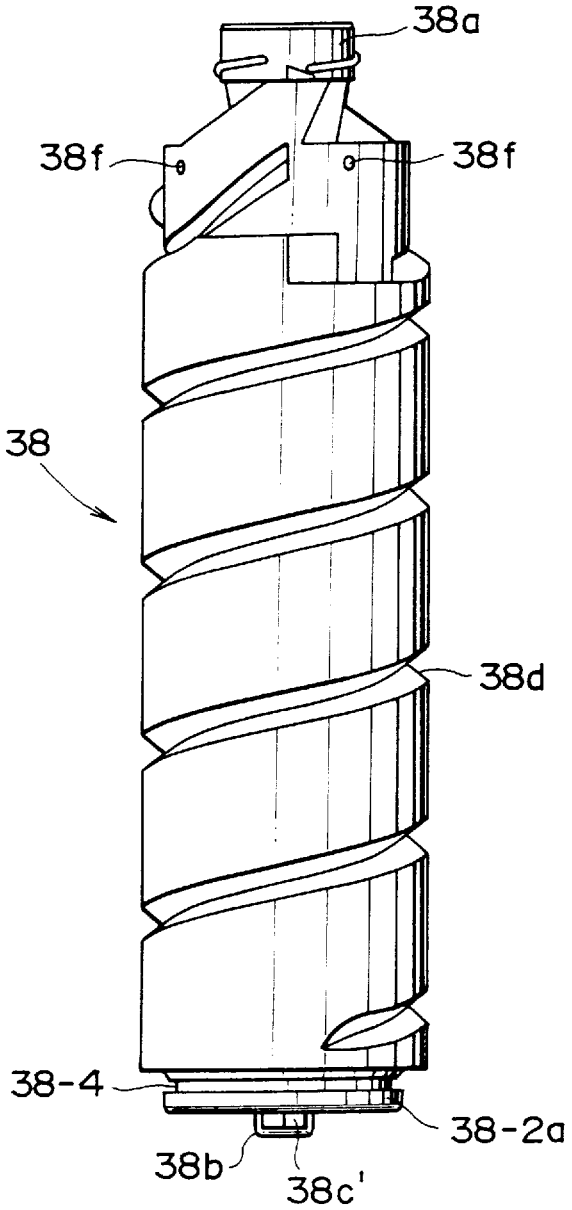
FIG. 20 is a right-side view of the toner bottle.
Figure 21:
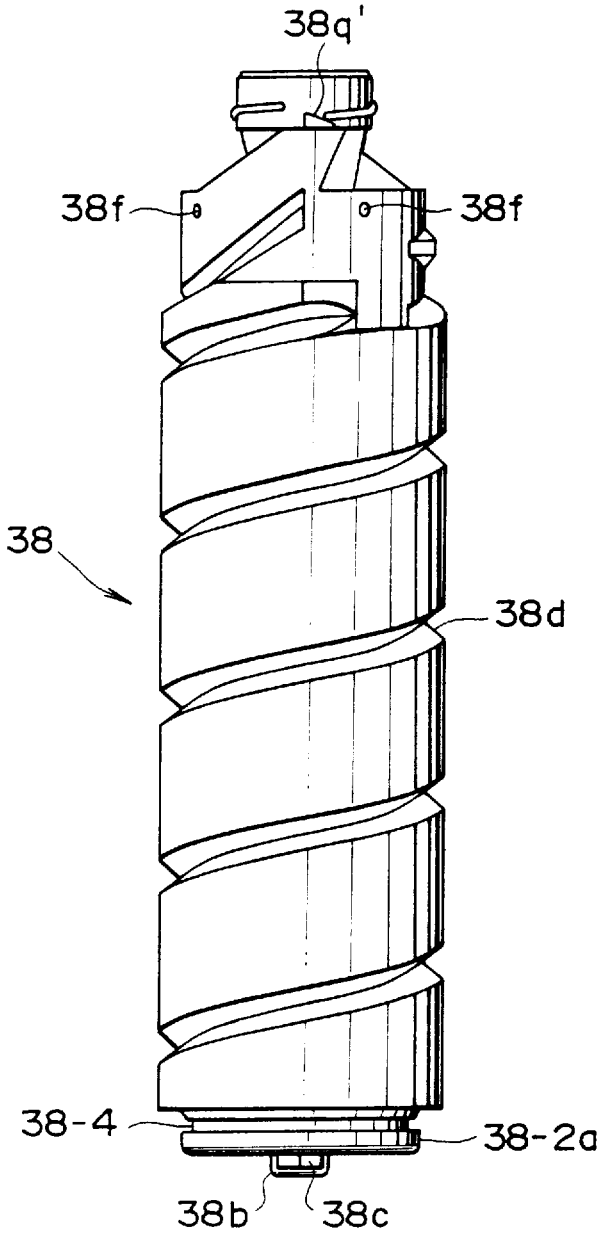
FIG. 21 is a left-side view of the toner bottle.
Figure 22:
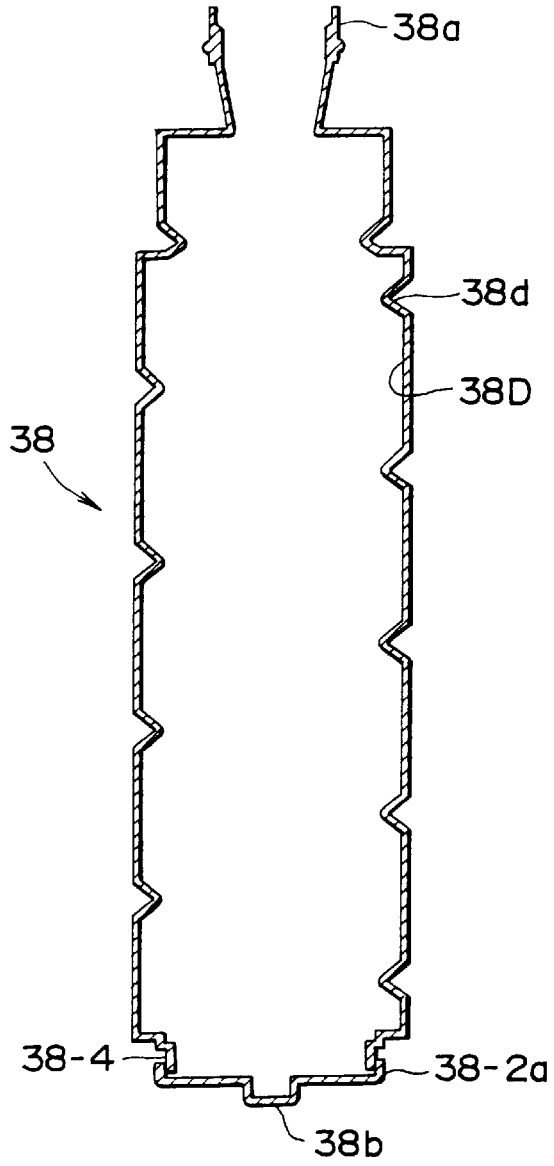
FIG. 22 is a sectional view of the toner bottle which has been cut by the K—K line of FIG. 18.
Figure 23:
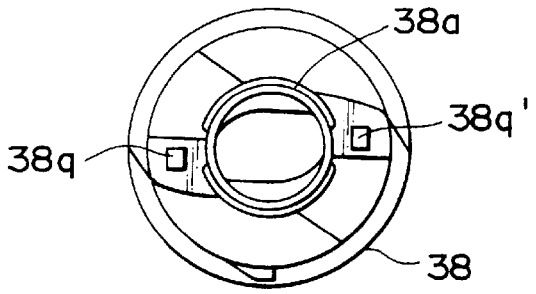
FIG. 23 is a top plan view of the toner bottle.
Figure 24:
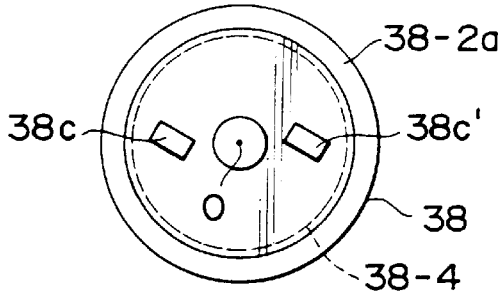
FIG. 24 is a bottom plan view of the toner bottle.

FIG. 17 is a perspective view of the toner bottle, showing the basic construction thereof. In FIG. 17, view arrows a to e designate view directions for grasping the toner bottle. FIG. 18 is a front view of the toner bottle, showing a configuration thereof of being viewed from the direction of view arrow a. Likewise, FIG. 19 is a back view of the toner bottle, showing a configuration thereof of being viewed from the direction of view arrow b. FIG. 20 is a right-side view of the toner bottle, showing a configuration thereof of being viewed from the direction of view arrow c. FIG. 21 is a left-side view of the toner bottle, showing a configuration thereof of being viewed from the direction of view arrow d. FIG. 23 is a top plan view of the toner bottle, showing a configuration thereof of being viewed from the direction of view arrow e. FIG. 24 is a bottom plan view of the toner bottle, showing a configuration thereof of being viewed from the direction of view arrow f. FIG. 22 is a sectional view of the toner bottle which has been cut by the K—K line in FIG. 18.

EXAMPLE A

Figure 16:
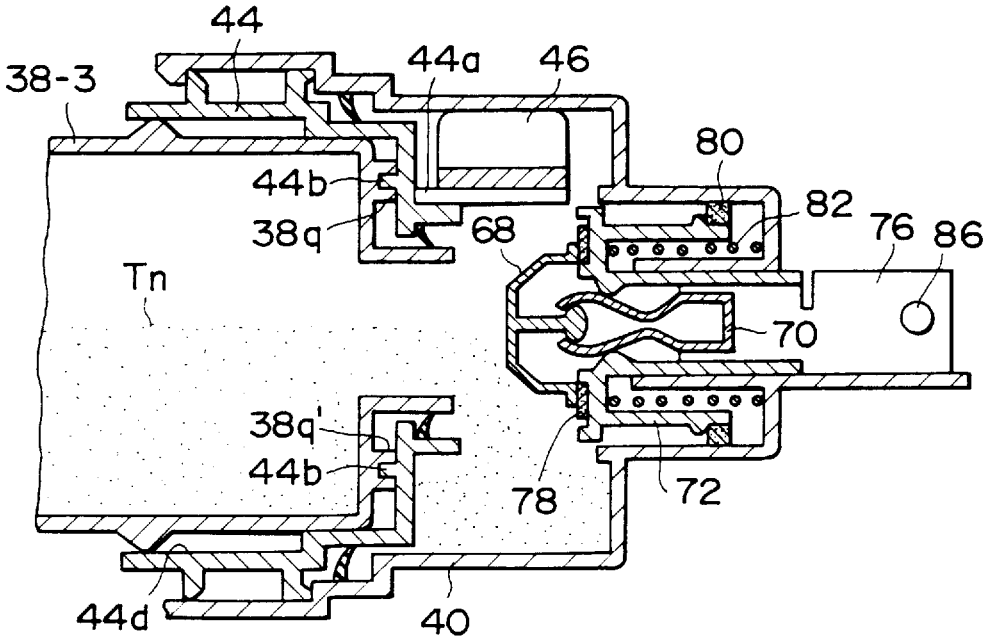
FIG. 16 is a sectional view showing a state in which the cap of the toner bottle held by the bottle holding member has been removed and toner is being discharged.

In FIG. 17 to FIG. 30, reference character 38-1 designates a cylindrical body portion, and an end thereof is closed. This closed part is shown as a bottom portion 38-2. The port portion 38*a* from which the toner is discharged is formed in the narrowed part of the other end of the body portion 38-1. In the inner wall from the body portion 38-1 to the port portion 38*a*, the spiral groove 38D through which the toner is transferred is formed continuously from the body portion 38-1 on the side of the bottom portion 38-2 toward the port portion 38*a*. Herein, the spiral groove 38D is equivalent to the spiral groove 38*d* in the outside circumference thereof. Incidentally, for convenience sake, the toner bottle 38 is shown in a state in which the opening of the port portion 38*a* is directed upward in FIG. 17 to FIG. 22, however, as shown in FIG. 15 and FIG. 16, the toner bottle 38 is mounted in the toner supply unit 6 practically in a state in which the port portion 38*a* is directed longitudinally. If the toner bottle 38 is rotated, the toner in the toner bottle 38 is guided by the spiral groove 38D and then is sent outside through the spiral groove 38D.

In a position outside the bottom portion 38-2 and away from a cylindrical central-axis line 0—0, as shown in FIG. 18 and FIG. 24, there are formed projections 38*c*, 38*c*′ in the axial direction which has a square-pillar-like convex portion. Herein, The projections 38*c*, 38*c*′ is used for transferring torque to the toner bottle 38. In this example, a square-pillar-like convex portion is used as the axial-direction projections 38*c*, 38*c*′, yet, configuration thereof is not restricted to this, in other words, any configuration whose portion is engaged easily with the convex portions 62*b*, 62*b'* which are driving sources of the torque can be used thereas. An shown in FIG. 30, in a nutshell, any projection can be suitable if it is engaged with the convex portions 62*b*, 62*b'* of the joint 62 which is rotated pivoting on an axial line 0. Accordingly, the joint 62 is rotated in the direction of arrow E, and thereby the convex portion 62*b*, 62*b'* are engaged with the axial-direction projections 38*c*, 38*c'*, respectively so that the toner bottle 38 is rotated. In this case, needless to say, the port portion 38*a* is held rotatably by holding means.

As mentioned above, the axial-direction projections 38*c*, 38*c'* for transferring torque is formed not on the side of a port portion through which toner is discharged but on the side of the bottom portion 38-2, and thereby vibration on the side of the port portion 38*a* can be lessened. In addition, the two axial-direction projections 38*c*, 38*c'* whose center is on the central-axis line 0—0 and which are spaced away from the central-axis line 0—0 is formed, and thus, substantially a couple of torque work. Thereby, any force which is thrown off in the radius direction is not given to the toner bottle 38 even while the toner bottle 38 is rotated. As a result, the necessity of making the countermeasure for preventing the toner bottle 38 from being thrown off is eliminated or lightened so that the construction can be simplified as well as stable supply of toner can be realized.

EXAMPLE B

Outside the bottom portion 38-2 and on the central-axis line 0—0, a cylindrical center 38*b* for determining the central position thereof is formed to project by Δh in the axial longitudinal outward direction from the axial-direction projections 38*c*, 38*c'* (see FIG. 18). The cylindrical center 38*b*, as shown in FIG. 3 and FIG. 5, is inserted into the concave portion 62*a* of the joint 62, and thus, the bottom part of the toner bottle 38 is held at a position. Especially, the reason why the cylindrical center 38*b* is projected by Δh in the axial longitudinal outward direction from the axial-direction projections 38*c*, 38*c'* is as follows.

In brief, the position in which the joint 62 stops rotating is unstable, and thus, there is a possibility that the position of the convex portion 62*b*, 62*b'* say be overlapped with the axial-direction projections 38*c*, 38*c'* when the toner bottle 38 is mounted. In this case, the torque cannot be transferred by engaging the convex portion 62*b*, 62*b'* with the axial-direction projections 38*c*, 38*c'*. As shown in this embodiment, however, if the center 38*b* is made higher than the axial-direction projections 38*c*, 38*c'* at least the end part of the center 38*b* is inserted into the concave portion 62*a*. Therefore, the joint 62 can be rotated even in a state in which the position of the convex portion 62*b*, 62*b'* is overlapped with the axial-direction projections 38*c*, 38*c'*. As a consequence, the position of the convex portion 62*b*, 62*b'* is deviated from the axial-direction projections 38*c*, 38*c'*.

Figure 30:
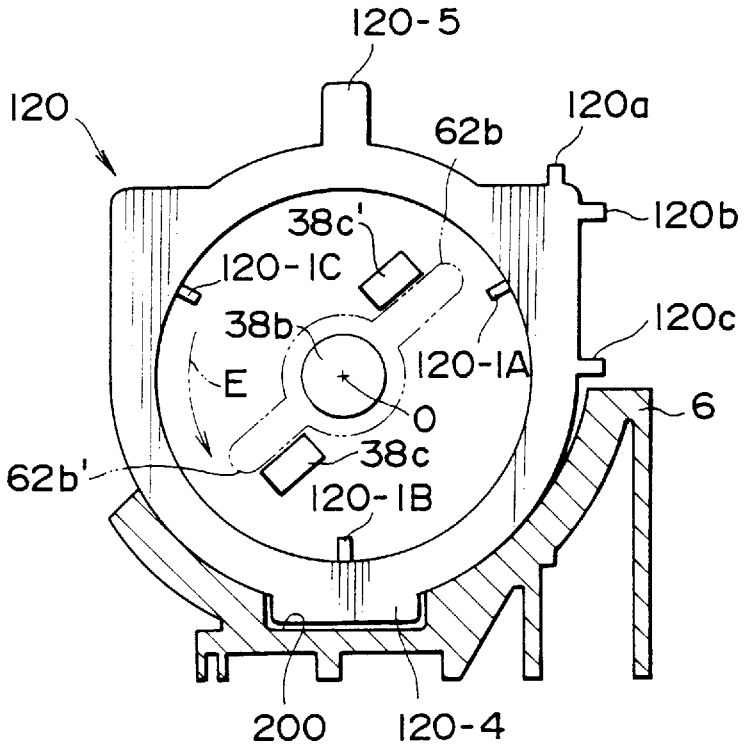

On the other hand, the stress of the spring 64 keeps placed on the joint 62, and thus, the joint 62 falls automatically into the axial-direction projections 38*c*, 38*c'* and thereby the rotation of the joint 62, as shown in FIG. 30, leads to a state in which the torque can be transferred to the toner bottle 38 when the position of the convex portion 62*b*, 62*b'* is deviated from the axial-direction projections 38*c*, 38*c'*.

Accordingly, there is not required the control of stopping the joint 62 at a specific rotational position in this embodiment.

EXAMPLE C

The cylindrical middle portion 38-3 which holds the toner bottle 38 and also is engaged with the bottle holding member 44 is formed the port portion 38*a* in a part closer to the bottom portion 38-2 than the port portion 38*a*. The bottle holding member 44 is formed cylindrically and leads the toner discharged from the port portion 38*a* to a predetermined part by rotating synchronously with the toner bottle 38. The middle portion 38-3, which is a part of the body portion 38-1, is smaller in diameter than the body portion except therefor and larger than the port portion 38*a*. Naturally, the spiral groove 38D is also formed in the inner wall of the middle portion 38-3.

In the outer circumferential part of the middle portion 38-3, as shown in FIG. 15, the small projection 38*f* which is brought into contact with the inner circumferential surface of the bottle holding member 44 and holds the toner bottle 38 without its being deviated from the rotational center of the bottle holding member 44 is formed. The small projection 38*f* is formed at positions where the circumference thereof is divided at regular intervals so as to come into contact uniformly with the inner circumferential surface of the bottle holding member 44. In this example, four small projections 38*f* are formed at intervals of an angle of 90°. Although the number of the small projections 38*f* may be sore or less than four pieces in addition to four pieces in this example, the minimum values are limited to 3 pieces or a 120 degrees interval in order to stabilize the position. Herein, the size of the small projections 38*f* is determined by the relation in inner diameter between the middle portion 38-3 and the bottle holding member 44. In consideration of the easiness of attaching or removing the toner bottle 38, it is desirable that the small projections 38*f* is brought into contact with the bottle holding member 44 by the extent to which the contact pressure thereof does not become excessively high.

In the case mentioned above, the stall projections 38*f* is held accurately on the inner radius part of the bottle holding member 44, and thereby the toner bottle 38 and the body portion 38-1 are located rotatably by being centered on the incurvated inner radius part for holding a toner bottle which is formed in the toner receiving stand 42. Hence, the toner bottle 38 is rotated without being vibrated so that stable supply of toner can be realized.

EXAMPLE D

The drive claws 38*q*, 38*q'* are formed projecting in the direction of the central-axis line 0—0 in the end surface of the middle portion 38-3, the so-called shoulder portion, on the side of the port portion 38*a*. The drive claws 38*q*, 38*q'* are hooked by the bottle holding member 44, in more detail, the rib 44*b* which is rotated synchronously with the bottle holding member 44 so that the extruding member 46 is rotated. Herein, the drive claws 38*q*, 38*q'* are disposed facing to each other in the diametrical direction of the middle portion 38-3. The rotation of the toner bottle 38 is transferred to the bottle holding member 44 through the medium of the rib 44*b* by the drive claws 38*q*, 38*q'*.

Since the drive claws 38*q*, 38*q'* and the rib 44*b* are formed by small pieces, there is only a little probability by which they collides with each other in the axial direction in the case where the toner bottle 38 moves in the axial direction. The extruding member 46 is rotated by the rotation of the bottle holding member 44, and thereby the toner which has been discharged from the port portion 38*a* and transferred into the toner hopper portion 40 is scratched up. Thereafter, the toner is flown from the opening portion 48 into the developing unit 10 through the toner supplying port 54.

According to this construction in which the simple drive claws 38*q*, 38*q'* protrudes from the end side of the middle portion 38-3, the toner in the toner hopper portion 40 can be carried automatically outside the toner hopper portion by being rotated with the toner bottle 38 without any other driving means.

EXAMPLE E

Figure 25:
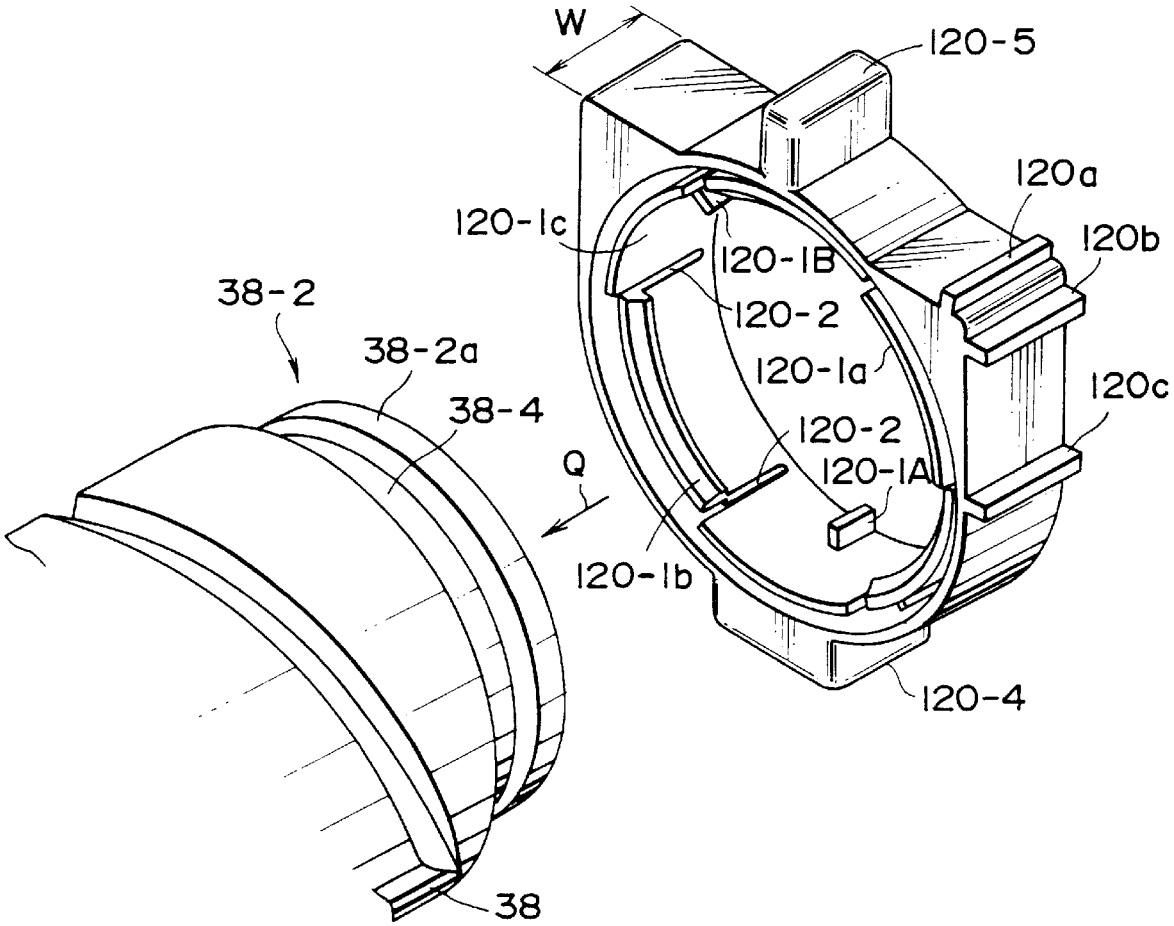
FIG. 25 is a perspective view of a ring and a bottom part of the toner bottle.
Figure 26A:
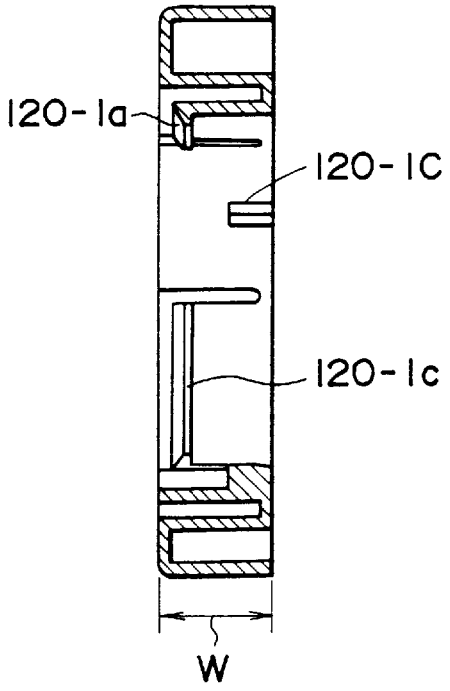
FIG. 26(*a*) is a sectional view of the ring cut by the P—P line of FIG. 26(*b*).
Figure 26B:
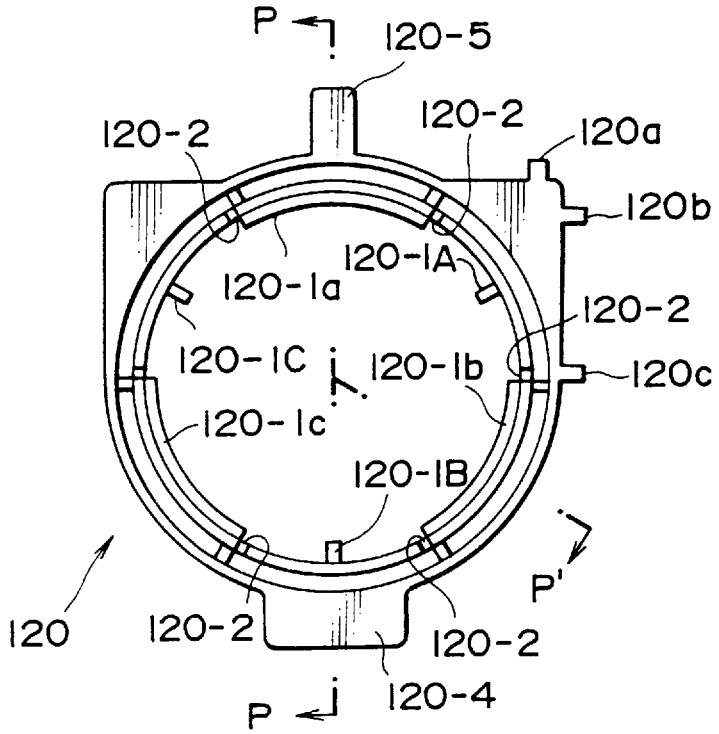

A ring 120 shown in FIGS. 25, 26(*a*) and 26(*b*) can be fit rotatably in the bottom portion 38-2 of the toner bottle 38 which is shown in FIG. 17 to FIG. 24 so that it say not shift in the axial-longitudinal direction of the toner bottle 38 during rotation. FIG. 26(*a*) is a sectional view of view arrow P—P shown in FIG. 26(*b*). An convex outer circumferential portion 38-2*a* which is formed in the bottom portion 38-2, three elastic claw members 120-1*a*, 120-1*b*, 120-1*c* which are formed in the inner circumferential part of the ring 120, three stoppers 120-1A, 120-1B, 120-1C which are formed in the inner circumferential part of the ring 120, and the like, as shown in FIGS. 25, 26(*a*) and 26(*b*), are used as engagement means for engaging the toner bottle 38 with the ring 120 by which deviation thereof can be avoided. Besides, A groove designated by reference character 38-4 in FIG. 18, etc. is formed between the convex outer circumferential portion 38-2*a* and the body portion 38-1.

The three elastic claw members 120-1*a*, 120-1*b*, 120-1*c* are disposed at three positions, by which the inner circumference of the ring 120 is divided at an equal interval, on the inner circumference thereof The three elastic claw members 120-1*a*, 120-1*b*, 120-1*c* consist of holding-by-one-side elastic members, one of whose ends is integrated with a ring body. Holding-by-one-side stopper holding members is disposed between each of the three elastic claw members 120-1*a*, 120-1*b*, 120-1*c*, and the stoppers 120-1A, 120-1B, 120-1C are formed in the three stopper holding members.

The parts on the basic end sides of the three elastic claw members 120-1*a*, 120-1*b*, 120-1*c* and the three stopper holding members are divided by the tedium of SURIWARI portions, yet, a have a construction of a circular inner circumferential surface as a whole, and in addition, they are of a size by which rotation can be made rubbing without generating any rotational vibration when being engaged with the convex outer circumferential portion 38-2*a*.

The three elastic claw members 120-1*a*, 120-1*b*, 120-1*c* have a fluke-like shape, that is, a shape of being bent in the inward direction, in the free ends thereof. As shown by arrow Q in FIG. 25, the ring 120 is fit in the toner bottle 38 by being pushed into the convex outer circumferential portion 38-2*a*, and thereat, the free ends of the three elastic claw members 120-1*a*, 120-1*b*, 120-1*c* yield, and then the claw parts thereof go beyond the convex outer circumferential portion 38-2*a* to cone into the groove 38-4. On this occasion, the convex outer circumferential portion 38-2*a* is seized by the three elastic claw members 120-1*a*, 120-1*b*, 120-1*e* and the stoppers 120-1A, 120-1B, 120-1C, in a state in which flexible rubbing movement thereof is maintained. Hence, the ring 120 is designed to avoid being detached easily once having been engaged, which allows the ring 120 to function sufficiently. Each of the three elastic claw members 120-1*a*, 120-1*b*, 120-1*c* has a rectangular bent-up portion to be fit in the rectangular part around the convex outer circumferential portion 38-2*a* in order to avoid being detached, and thus, the rectangular part is fit in the rectangular part around the convex outer circumferential portion 38-2*a* so that coming-off in the axial direction and separation can be prevented.

In short, the convex outer circumferential portion 38-2*a* is grasped by the three elastic claw members 120-1*a*, 120-1*b*, 120-1*c* and the stoppers 120-1A, 120-1B, 120-1C so that the toner bottle 38 can be rotated over the ring 120 without being deviated.

EXAMPLE F

Figure 27:
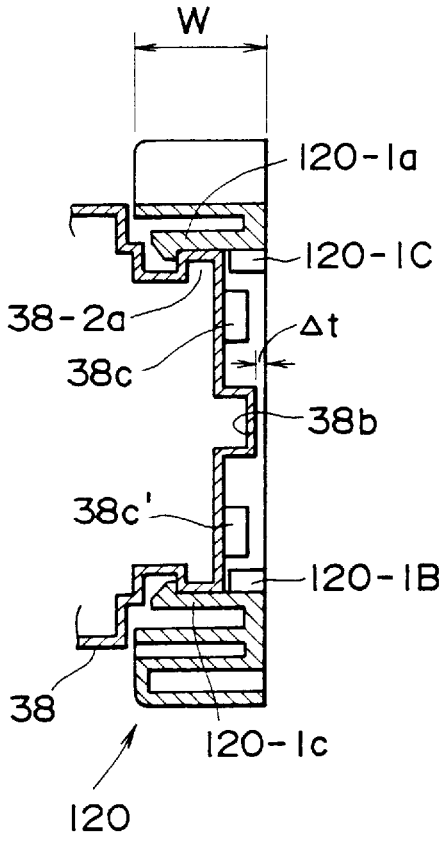
FIG. 27 is a sectional view of the ring fitted on the toner bottle.

As shown in FIG. 27, an end of the ring 120 is opposite adjacently to the periphery of an end of the body portion 38-1 of the toner bottle 38, and further, the convex outer circumferential portion 38-2*a* is smaller in diameter than the body portion 38-1, and the end surface part of the toner bottle 38 which is defined by the difference in diameter covers the elastic claw members 120-1*a*, 120-1*b*, 120-1*c*. As mentioned above, moreover, the toner bottle 38 cannot move over the ring 120 in the axial direction, and thus, the three elastic claw members 120-1*a*, 120-1*b*, 120-1*c* cannot be operated from outside, which virtually makes it impossible to remove the ring 120. If the ring 120 has been forcibly detached by external force, the convex outer circumferential portion 38-2*a* of the toner bottle 38 may be broken.

The ring 120 is fixedly engaged with the toner bottle 38 because the ring 120 needs to be integrated securely with the toner bottle 38 so that the ring 120 can have one or more functions among a function of irreplaceability, a function as a stand and a function of preventing rotation, as shown in the following.

EXAMPLE G

An example, which will be mentioned in the following, is concerned in a stand function of the ring 120. The ring 120 has a predetermined width W in the axial longitudinal direction. FIG. 27 is a sectional view, showing a case where the ring 120 is cut by the line corresponding to the sectional plane of view arrow P-O-B' in FIG. 26(*b*) in a state in which the ring 120 is fit in the convex outer circumferential portion 38-2*a* of the toner bottle 38. As seen in FIG. 27, the predetermined width W is determined to make an end of the ring 120 brought in contact with the end surface of the body portion 38-1 of the toner bottle 38 in a mounted state, as well as to make the other end thereof located in a more outward direction than the center 38*b*. In a nutshell, the other end of the ring 120 is made higher by Δt than the outer plane of the center 38*b*. Consequently, not only the center 38*b* but also the axial-direction projections 38*c*, 38*c'* lie in a more inward direction than the other end of the ring 120.

Figure 28:
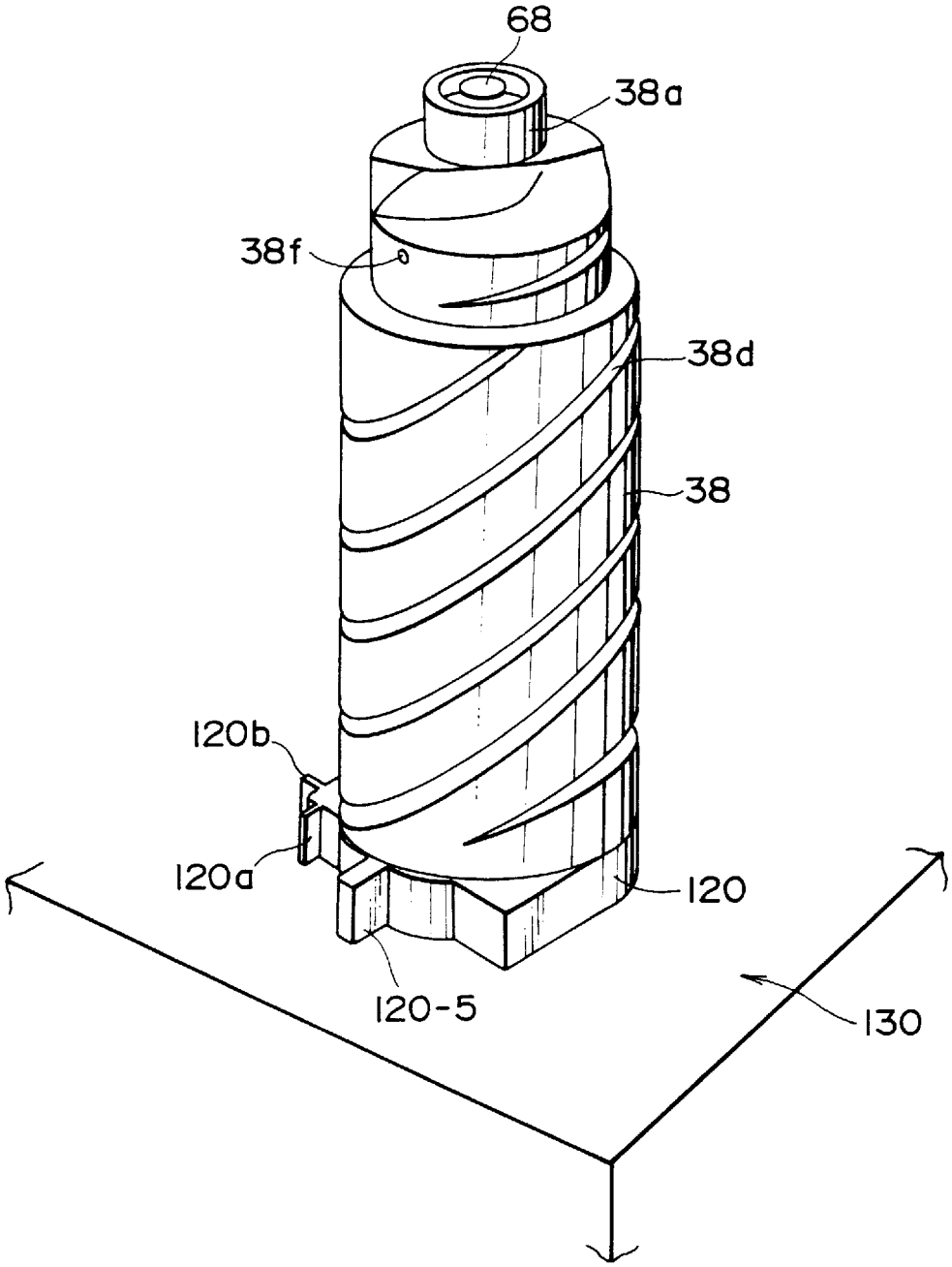
FIG. 28 is a perspective view of the ring and the toner bottle, showing a state in which the toner bottle with the ring is erected.

Accordingly, the toner bottle 38 in which the ring 120 has been mounted, as shown in FIG. 28, can be stood on a plane of a table 130 or the like. Without this type of ring 120, the center 38*b* protrudes from the bottom of the toner bottle 38 so that the toner bottle 38 cannot be stood, as shown in FIG. 12. Therefore, a cylindrical toner bottle is held on its side in a state of being easy to roll in such a case that the toner bottle is exchanged, and thus, the toner bottle may drop from a table or the like to a floor. In this respect, if the ring 120 is used, as shown in this example, a toner bottle is stood in a stable state so that the fall accident thereof can be decreased.

EXAMPLE H

This embodiment is concerned in a function of preventing the ring 120 from rotating.

In the peripheral part of the ring 120, as shown in FIG. 25, there is formed a projection 120-4 in the radius direction which has a predetermined configuration and size so as to become engaged with a concave portion 200 which is formed in the toner receiving stand 42 as an immovable member. In this example, the radius-direction projection

120-4 is shaped like a rectangular parallelepiped. On the other hand, the concave portion 200 which is formed in the toner receiving stand 42 has a size and a rectangular configuration by which the concave portion 200 can be engaged with the radius-direction projection 120-4. As shown in FIG. 5, the toner bottle 38 is mounted in the toner receiving stand 42 by inserting the radius-direction projection 120-4 into the concave portion 200.

If the attachment is done by the method mentioned above, the ring 120 can be prevented from rotating over the toner receiving stand 42, as well as, the toner bottle 38 is held and rotated stably on the ring 12 as a bearing since the ring 120 is positioned precisely on the basis on the relationship between the radius-direction projection 120-4 and the concave portion 200. Furthermore, the radius-direction projection 120-4 can be engaged with the concave portion 200 merely by raising the ring together with the toner bottle as having a simple structure of being protruded outwardly. Accordingly, the attachment-or-detachment operation is carried out without difficulty.

EXAMPLE I

This example is concerned in a function of irreplaceability of the ring 120.

The ring 120 has a projection 120-5 for preventing a predetermined type of toner bottle from being exchanged by the other types of toner bottle in the part opposite to the radius-direction projection 120-4 in the radius direction. The projection 120-5 is shaped to have a specific relation corresponding to the toner bottle 38. In this example, the projection 120-5 has a plate-like shape.

On the front plane of the apparatus-body front plate 69, as shown in FIG. 5, there is disposed a discerning member 141 having a MIZO 140 which has a width of being coupled with a certain ring, for instance, the projection 120-5 of the ring 120. The discerning member 141 is positioned to be joined together with the toner bottle 38 containing toner used for the image forming apparatus and the ring 120 attached to the toner bottle 38.

Figure 29A:
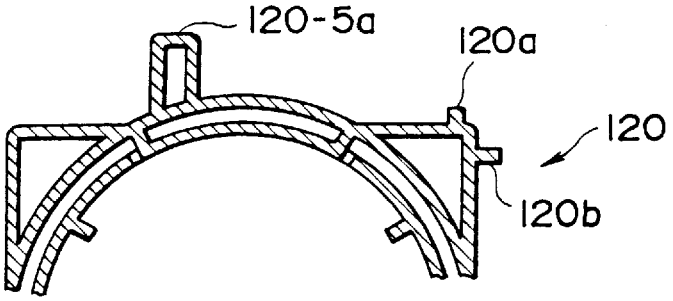
FIGS. 29(*a*), 29(*b*) band 29(*c*) are views showing examples of various types of projections for preventing the toner bottle from being interchanged with other types of toner bottles.
Figure 29B:
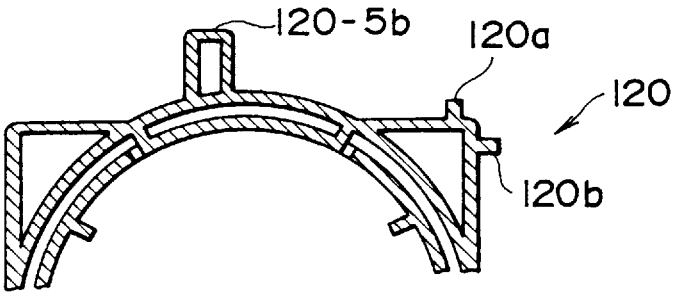
Figure 29C:
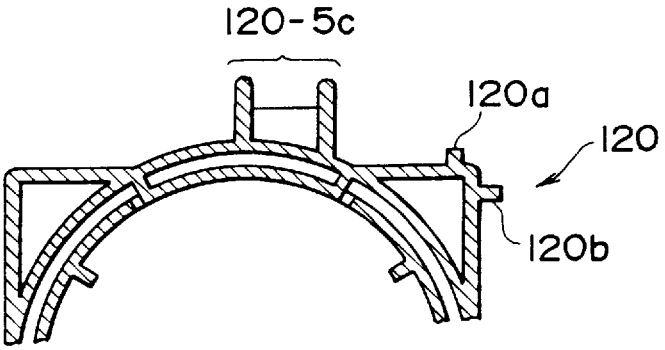

If a toner bottle to which the ring 120*a* hating the projection 120-5 is attached is used, as shown in FIG. 5, the position of the projection 120-5 corresponds to that of MIZO 140 so that the toner bottle 38 can be set up without any problem. With respect to a user side or maintenance service side, as shown in FIGS. 29(a), 29(b) and 29(c), various types of projections 120-5*a*, 120-5*b*, 120-5*c*, etc., each of which is different from each other in its position or shape, may he used for a variety of image forming apparatuses.

Even though a toner bottle having a ring which has any one of the projections 120-5*a*, 120-5*b*, 120-5*c*, etc., attempts to be installed by mistake in the toner supply unit 6 shown in FIG. 5, the toner receiving stand 42 is prevented from being moved in the more inward direction than a point of place where the discerning member 141 is disposed and then from being set up in the toner supply unit 6 because all of the projections 120-5*a*, 120-5*b*, 120-5*c*, etc., differ in disposed position or configuration from the projection 120-5. In brief, the ring 120 his an irreplaceability function of the toner bottle 38 so that a toner bottle different from the toner bottle containing toner peculiar to the image forming apparatus can avoid being selected.

In many cases where different kinds of toner is used in terms of the combination of mixing additives as charge control materials, depending upon the developing speed of various types of image forming apparatuses, the image forming function may be damaged if toner which is not matched to the property is used. Accordingly, an irreplaceability function as mentioned in this example is significant.

Incidentally, in this embodiment, the projection 120-5, which protrudes outwardly in the radius direction of the ring 120 is shown as an example, yet, the projection 120-5 may protrude inwardly. In short, the position or configuration of a projection say be determined at will so far as the discerning member 141 has a function of choosing a single type of projection among others.

All of the three constructions relating to the aforementioned functions, that is, the function of irreplaceability, the function as a stand and the function of preventing rotation, may be used in a single ring, and naturally, a ring may be constructed to use only one function among them.

Besides, ribs 120*a*, 120*b*, 120*c* are formed in the ring 120. The ribs 120*a*, 120*b*, and the rib 120*c*, come into contact with the guide 108*n*, and the guide 108*m*, respectively. Thereby, the guiding operation can be stabilized and also the positioning accuracy can be heightened at the time that the ring 120 is inserted into the toner receiving stand 42.

In the ring 120, the side of the radius-direction projection 120-4 is shaped substantially circularly, compared with the side of the projection 120-5. On the other hand, the side of the projection 120-5 projects angularly on the both end sides thereof. This configurational characteristic enables an operator not to mistake the side of the projection 120-5 for the side of the radius-direction projection 120-4, and vice versa. In other words, it can be easily judged that a projection on the side of being shaped substantially circularly is equivalent to the radius-direction projection 120-4, and a projection on the other side is equivalent to the projection 120-5 by making the configuration of the ring 120 asymmetric. As a consequence, misjudgment can be avoided.

Next, other embodiments according to this invention is shown in FIGS. 31 to 34.

Figure 31:
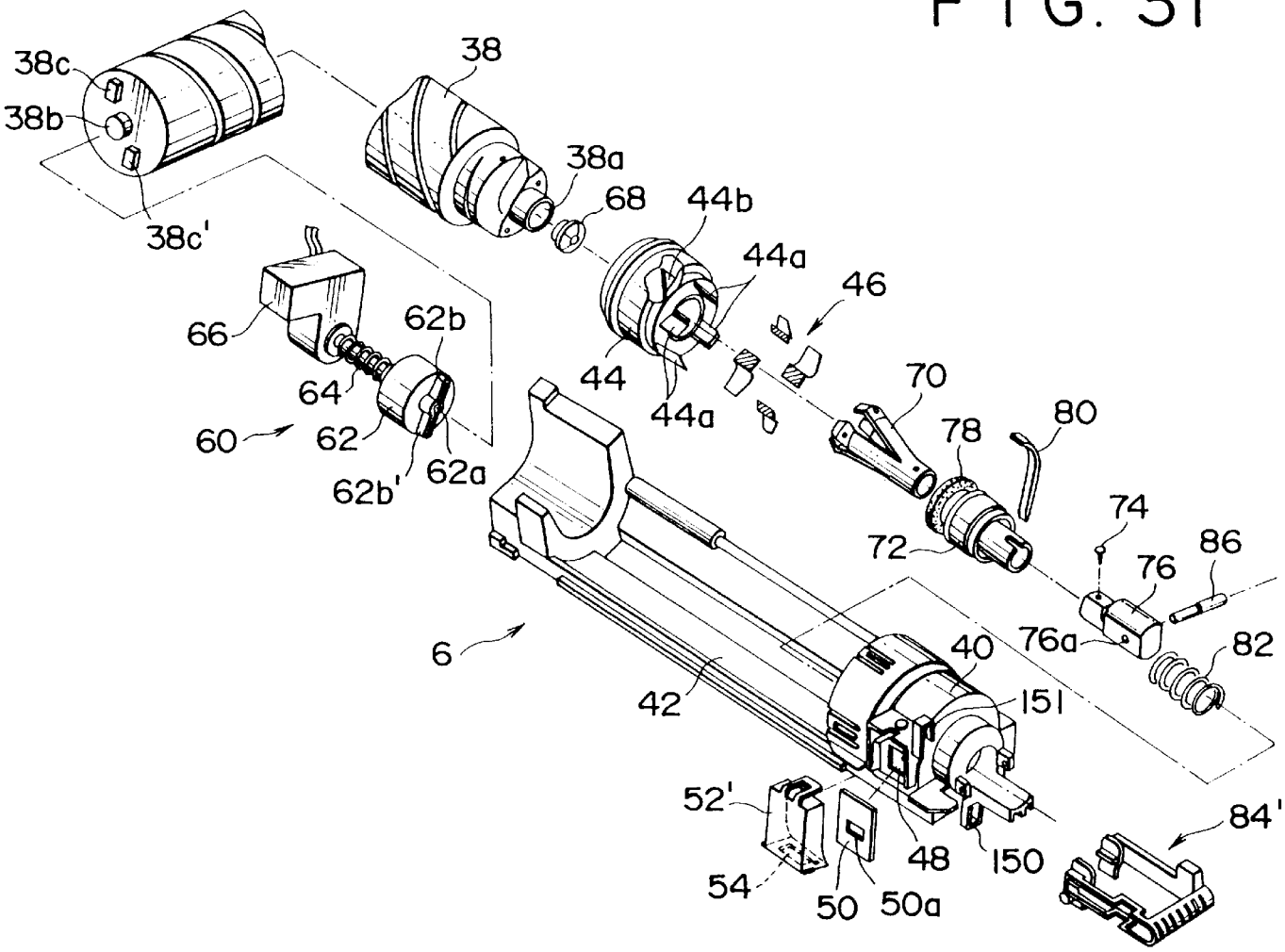
FIG. 31 is an exploded perspective view of the toner supply unit according to another embodiment.

In the rear-end of the toner bottle 38 according to this embodiment, as shown in FIG. 31, there is not inserted a ring (reference character 120 in FIG. 30). No sore than the supply-amount regulating member 50 having the slit hole 50*a* is disposed in the opening portion 48 of the toner hopper portion 40, in a nutshell, a shutter member (reference character 88 in FIG. 30) is not disposed therein. In addition, a handle 84' having a configuration different from the handle 84 is used.

The amount of toner supply can be regulated properly by determining the length (the horizontal direction) and the width (the vertical direction) of the slit hole 50*a* as the occasion may demand. The extruding members 46 are stuck on the ribs 44*a* so as to protrude by substantially 1 mm from the slit hole 50*a*. In this embodiment, not a hole within which a projection is moved (reference character 52*a* in FIG. 30) or the like, but only the toner supplying port 54, is formed in a toner introducing cover 52' since any shutter member is not disposed.

Figure 32:
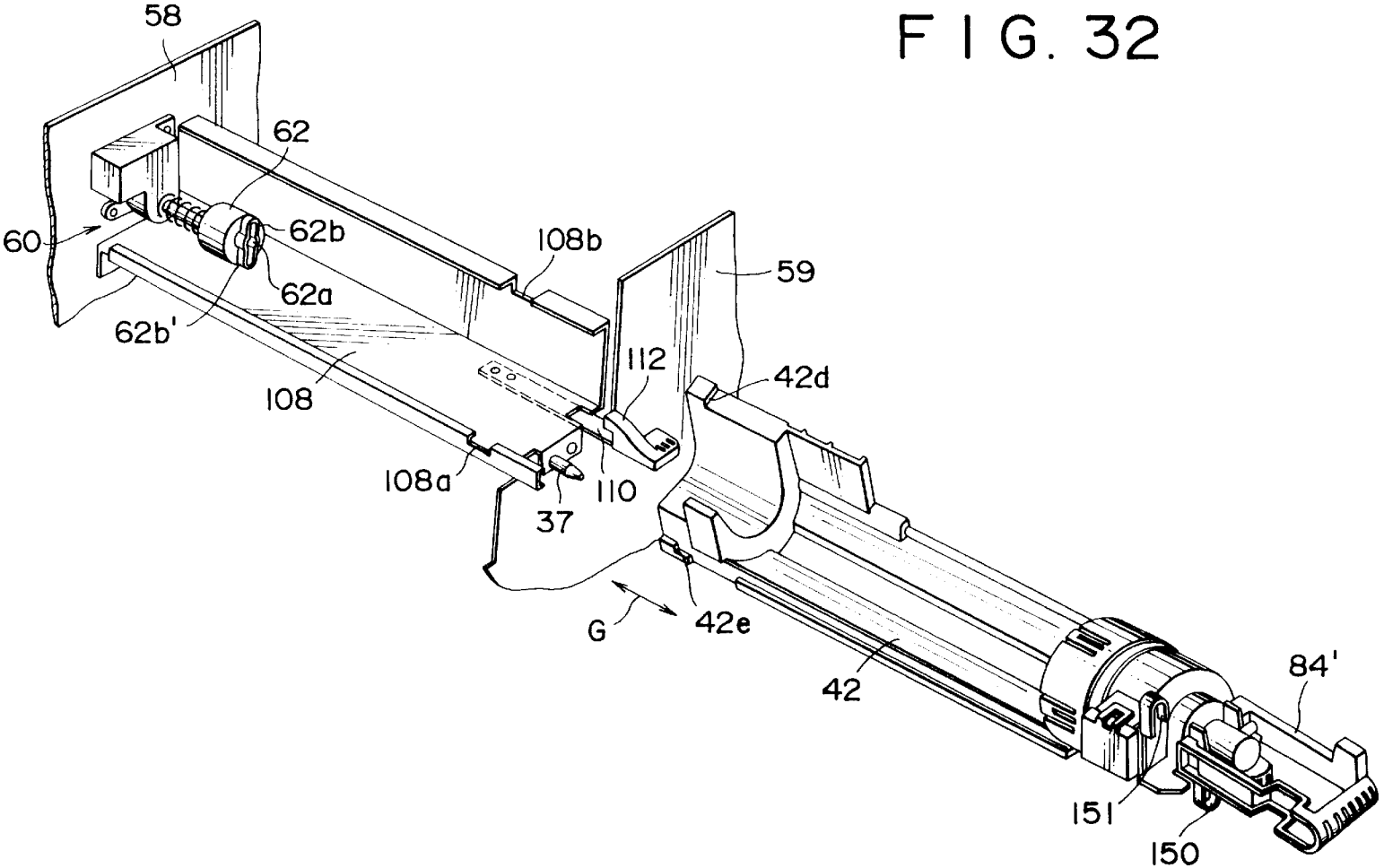
FIG. 32 is an perspective view of the toner supply unit according to still another embodiment.

The construction in which the toner supply unit 6 is attached to or detached from the apparatus body has been described in the aforementioned embodiment. Hereinafter, there will be described in detail in relation to the construction. As shown in FIG. 32, a pin 37 is disposed in the apparatus-body front plate 59. Herein, the pin 37 is inserted into a positioning hole 150 on the end side of the toner supply unit 6 when the toner supply unit 6 is installed in the apparatus body. Further, a pin (not shown) which is inserted into a positioning hole 151 is disposed in the apparatus-body front plate 59. Thereby, the toner supply unit 6 can be mounted with high precision at a predetermined position of the apparatus body. Then, the toner supply unit 6 is fixed by the stopper 112 when being mounted completely in the apparatus body.

Figure 33:
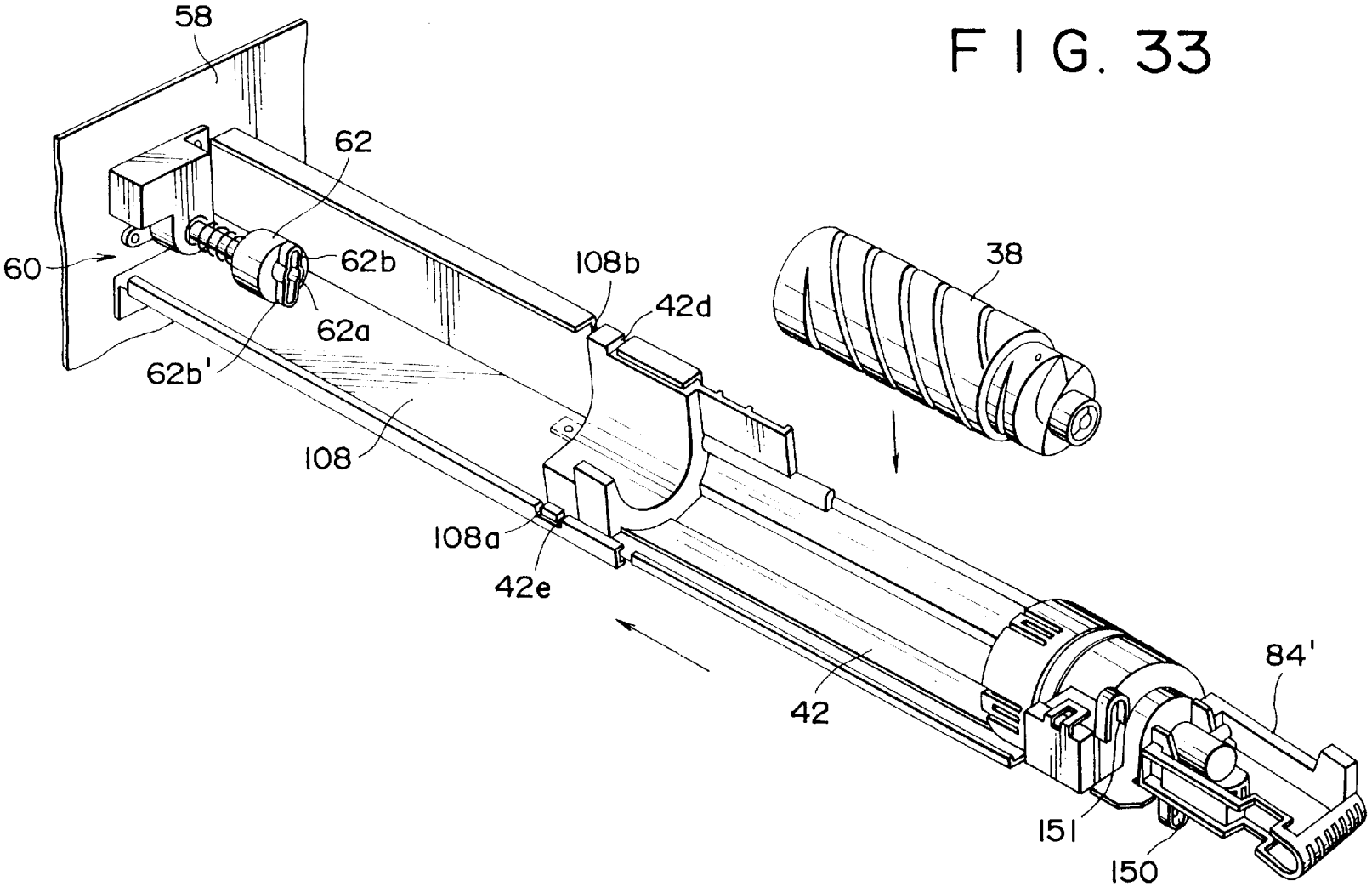
FIG. 33 is a perspective view of the toner supply unit according to still another embodiment, showing a state in which the toner supply unit has been drawn from the side of the apparatus body.

In FIG. 33, there is shown a state where the toner supply unit 6 has been drawn out of the apparatus body. Herein, step portions 42*d*, 42*e* are formed in the receiving stand 42, and notch portions 108*a*, 108*b* are formed in the guide plate 108. While the toner supply unit 6 is drawn out of the apparatus body, the step portions 42*d*, 42*e* are hooked by the notch portions 108*a*, 108*b* so that the toner supply unit 6 is kept in the state of being shown in FIG. 33.

In the state mentioned above, the toner bottle 38 which has been filled with toner is placed on the receiving stand 42, as shown by an arrow. Thereafter, the toner supply unit 6 is installed while being slid in the direction of being shown by the arrow on the guide plate 108.

Figure 34A:
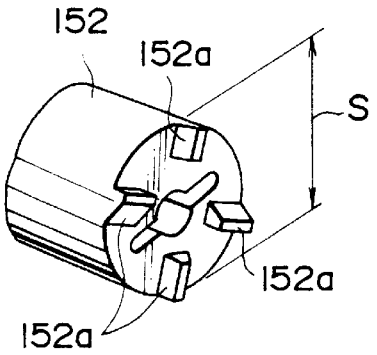
FIGS. 34(*a*) and 34(*b*) show a variant of a connection mechanism between a joint and the bottom part of the toner bottle, FIG. 34(*a*) shows an end surface of the joint, and FIG. 34(*b*) shows the bottom part of the toner bottle.
Figure 34B:
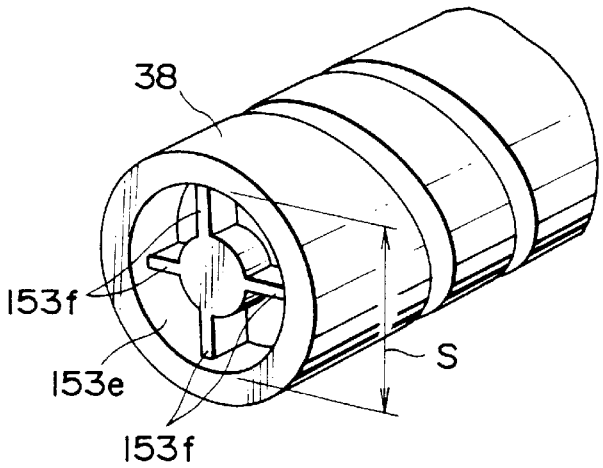

Next, a variation of the mechanism by which the toner bottle 38 is driven to rotate will be described, as shown in FIG. 34. In this variation, a joint 152 having a diameter of S used in lieu of the joint 62, and a plurality of convex portions 152*a* are formed on the end plane thereof. In the bottom part of the toner bottle 38, on the other hand, a plurality of ribs 153*f* are disposed inside of a concave portion 153*e* having a diameter of S.

In this construction, the concave portion 153*e* in the bottom part of the toner bottle 38 is positioned by becoming engaged with the joint 152 when the receiving stand 42 in which the toner bottle 38 is set up is pushed in. When the drive portion 60 starts driving, the side of the convex portions 152*a* of the joint 152 comes into contact with the ribs 153*f* of the concave portion 153*e*, and thereby the drive is transferred to the toner bottle 38.

What is claimed is:

1. An image forming apparatus, comprising:

a toner supply unit which is directly or indirectly attached to and detached from a body of the image forming apparatus having a toner receiving port, said toner supply unit having:

a toner supply port facing said toner receiving port when said toner supply unit is attached to the body of the image forming apparatus; and a shutter member for opening and closing said toner supply port;

wherein said shutter member consists of a bendable elastic member and a holding member for holding said bendable elastic member, said shutter member intersecting with an opening surface of said toner supply port; and said toner supply unit has a guiding portion for bending and guiding said bendable elastic member along said toner supply port.

2. An image forming apparatus according to claim 1, wherein said shutter member has a projection and, on a side of the body of the image forming apparatus, a guide rib is disposed which is engaged with said projection of said shutter member and serves to open or close said shutter member.

3. An image forming apparatus according to claim 1, wherein said toner supply unit has an elastic sealing member with which an end of said bendable elastic member comes in contact when said shutter member closes said toner supply port.

4. An image forming apparatus according to claim 1, wherein said toner supply unit has a deformation regulating guide for regulating deformation of said bendable elastic member suffered when said bendable elastic member is moved, said deformation regulating guide facing a surface of said bendable elastic member which is a reverse of a contact surface of said bendable elastic member brought into contact with said guiding portion.

5. An image forming apparatus according to claim 2, wherein said toner receiving port and said guide rib are formed in a process cartridge containing at least an image bearing medium and a developing unit which are formed integrally with each other, said process cartridge being attached to and detached from the body of the image forming apparatus, said process cartridge having a second shutter member for opening and closing said toner receiving port, said second shutter member having a second projection, said toner supply unit having guiding ribs which are engaged with said second projection and serve to open and close said second shutter member, said guide fib and said guiding ribs having engagable trapezoidal shapes.

6. An image forming apparatus according to claim 2, wherein said toner supply unit has an elastic sealing member with which an end of said bendable elastic member comes in contact when said shutter member closes said toner supply port.

7. An image forming apparatus according to claim 3, wherein said toner supply unit has a deformation regulating guide for regulating deformation of said bendable elastic member suffered when said bendable elastic member is moved, said deformation regulating guide facing a surface of said bendable elastic member which is a reverse of a contact surface of said bendable elastic member brought into contact with said guiding portion.

8. An image forming apparatus according to claim 4, wherein said shutter member has a projection and, on a side of the body of the image forming apparatus, a guiding rib is disposed which is engaged with said projection of said shutter member and serves to open or close said shutter member.

9. An image forming apparatus according to claim 6, wherein said toner receiving port and said guide rib are formed in a process cartridge containing at least an image bearing medium and a developing unit which are formed integrally with each other, said process cartridge being attached to and detached from the body of the image forming apparatus, said process cartridge having a second shutter member for opening and closing said toner receiving port, said second shutter member having a second projection, said toner supply unit having guiding ribs which are engaged with said second projection and serve to open and close said second shutter member, said guide rib and said guiding ribs having engagable trapezoidal shapes.

10. An image forming apparatus according to claim 6, wherein said toner supply unit has a deformation regulating guide for regulating deformation of said bendable elastic member suffered when said bendable elastic member is moved, said deformation regulating guide facing a surface of said bendable elastic member which is a reverse of a contact surface of said bendable elastic member brought into contact with said guiding portion.

11. An image forming apparatus according to claim 10, wherein said toner receiving port and said guide rib are formed in a process cartridge containing at least an image bearing medium and a developing unit which are formed integrally with each other, said process cartridge being attached to and detached from the body of the image forming apparatus, said process cartridge having a second shutter member for opening and closing said toner receiving port, said second shutter member having a second projection, said toner supply unit having guiding ribs which are engaged with said second projection and serve to open and close said second shutter member, said guide rib and said guiding ribs having engagable trapezoidal shapes.

12. A toner supply unit, comprising:

a toner bottle having a toner discharging port formed in a middle of an end of a cylindrical body of said toner bottle;

bottle holding means for holding said toner bottle substantially horizontally in a state in which toner can be introduced from said toner discharging port into a toner introducing portion of a developing unit; and rotational driving scans for rotating said toner bottle held by said bottle holding means around a central axis of said toner bottle extending in a longitudinal direction of said toner bottle;

wherein said toner bottle can be attached to and detached from a body of said toner supply unit in the direction of the central axis in a state in which said toner bottle is held by said bottle holding means.

13. A toner supply unit according to claim 12, wherein said toner bottle has a concave portion formed in a middle of the other end opposite to the end of the cylindrical body of said toner bottle in which said toner discharging port is formed, and said rotational driving means has an engagement portion for communicating a driving force by engagement with said concave portion.

14. A toner supply unit according to claim 12, wherein said toner bottle has convex portions formed in a middle of the other end opposite to the end of the cylindrical body of said toner bottle in which said toner discharging port is formed, and said rotational driving means has engagement portions for communicating a driving force by engagement with said convex portions.

15. A toner bottle, comprising:

a cylindrical body as a container for containing a toner;

a bottom portion with which an end of said body is closed; and a port for discharging a toner, said port being narrowly formed in another end opposite to the end of said bottom portion;

said cylindrical body having a spiral groove formed in an inner wall of said cylindrical body, said spiral groove spirally and consecutively extending from a side of said bottom portion toward said port so as to convey a toner through said spiral groove and discharge the toner from said port in accordance with rotation of said toner bottle;

wherein projections extending in a longitudinal direction of said toner bottle are formed to communicate a rotational force to said toner bottle on an outer surface of said bottom portion and away from a line of a central axis of said cylindrical body.

16. A toner bottle according to claim 15, further comprising a positioning center for determining a central position, said positioning center being formed on the outer surface of said bottom portion and existing on the line of the central axis of said cylindrical body, said positioning center extending in the longitudinal direction more than said projections.

17. A toner bottle according to claim 15 or 16, wherein said bottom portion has a convex circumferential portion on which a ring having a predetermined width in the longitudinal direction is rotatably fitted by means of fitting means, said fitting means preventing said ring from coming off from said body of the toner bottle in the longitudinal direction when said ring rotates.

18. A toner bottle according to claim 17, wherein the predetermined width of said ring is set so that an outer-sided end surface of said ring in the longitudinal direction is located outer that said positioning center.

19. A toner bottle according to claim 17, wherein said ring has a projection formed on a circumferential surface of said ring, said projection extending radially and being engaged with a concave portion of an immovable member.

20. A toner bottle according to claim 17, wherein said ring has a projection by which the toner bottle is prevented from being interchanged with another type of toner bottle.

21. A toner bottle according to claim 17, wherein said fitting means comprises stoppers formed on an inner surface of said ring, elastic claws, and said convex circumferential portion held between said stoppers and said elastic claws.

22. A toner bottle according to claim 21, wherein said convex circumferential portion is formed smaller in diameter than said cylindrical body of the toner bottle, the diameter of said convex circumferential portion being set so that said elastic claws are within an end plane space defined by a radial difference between said convex circumferential portion and said cylindrical body in a state in which said ring is fitted on the toner bottle.

23. A toner bottle according to claim 15, wherein:

a cylindrical intermediate portion is formed in a part of said cylindrical body closer to said port than said bottom portion, said cylindrical intermediate portion being engaged with a cylindrical bottle-holding member for holding the toner bottle and guiding a toner discharged from said port to a predetermined position by simultaneous rotation with the toner bottle; and small projections are formed on an outer circumferential surface of said cylindrical intermediate portion, said small projections rotatably positioning the toner bottle to be adjusted to a center line of an inner circumferential part of a toner receiving stand.

24. A toner bottle according to claim 15, wherein:

a cylindrical intermediate portion is formed between said port and said cylindrical body, said cylindrical intermediate portion being engaged with a cylindrical bottle-holding member for holding the toner bottle and guiding a toner discharged from said port to a predetermined position by simultaneous rotation with the toner bottle; and driving claws for communicating torque to said bottle holding member are formed on an end surface of said cylindrical intermediate portion on a side of said port.

* * * * *